US011532906B2

(12) United States Patent
Huang et al.

(10) Patent No.: US 11,532,906 B2
(45) Date of Patent: Dec. 20, 2022

(54) HYBRID SOCKET FOR HIGHER THERMAL DESIGN POINT PROCESSOR SUPPORT

(71) Applicant: Intel Corporation, Santa Clara, CA (US)

(72) Inventors: Yi Huang, Shanghai (CN); Fernando Gonzalez Lenero, Zapopan (MX); Liwei Zhao, Shanghai (CN)

(73) Assignee: Intel Corporation, Santa Clara, CA (US)

( * ) Notice: Subject to any disclaimer, the term of this patent is extended or adjusted under 35 U.S.C. 154(b) by 25 days.

(21) Appl. No.: 17/041,262

(22) PCT Filed: Jun. 29, 2018

(86) PCT No.: PCT/CN2018/093794
§ 371 (c)(1),
(2) Date: Sep. 24, 2020

(87) PCT Pub. No.: WO2020/000413
PCT Pub. Date: Jan. 2, 2020

(65) Prior Publication Data

US 2021/0057840 A1 Feb. 25, 2021

(51) Int. Cl.
*H05K 1/02* (2006.01)
*H01R 13/24* (2006.01)
(Continued)

(52) U.S. Cl.
CPC ..... *H01R 13/2414* (2013.01); *H01R 12/7076* (2013.01); *H01R 12/714* (2013.01)

(58) Field of Classification Search
CPC ..... H01R 13/2414; H01R 12/7076; H01R 12/714
See application file for complete search history.

(56) References Cited

U.S. PATENT DOCUMENTS 6,166,908 A 12/2000 Samaras et al.
6,360,431 B1 * 3/2002 Harrison ..... H05K 7/1092 29/830
(Continued)

FOREIGN PATENT DOCUMENTS

WO WO-2020000413 A1 1/2020

OTHER PUBLICATIONS

"International Application Serial No. PCT/CN2018/093794, International Search Report dated Mar. 29, 2019", 4 pgs.
(Continued)

*Primary Examiner* — Abdullah A Riyami
*Assistant Examiner* — Nelson R. Burgos-Guntin
(74) *Attorney, Agent, or Firm* — Schwegman Lundberg & Woessner, P.A.

(57) ABSTRACT

A power delivery system for a hardware processor includes a motherboard (MB), a voltage regulator (VR), an elastomer computer socket, and a plurality of power delivery paths within the socket. The socket connects the MB to the processor and comprises a first set of power pins that is connected to the processor by surface mount elements, and a second set of power pins that is not connected to the processor by surface mount elements. The plurality of electrical power delivery paths deliver VR power from the second set of C power pins to the first set of power pins for power delivery to the processor. The alignment frame aligns the processor, the plurality of power pins, and the MB. The plurality of power paths alone may meet the power demands of the processor. If not, a power plane from the MB provides additional power.

23 Claims, 19 Drawing Sheets

(51) Int. Cl.
*H01R 12/70* (2011.01)
*H01R 12/71* (2011.01)

(56) References Cited

U.S. PATENT DOCUMENTS 6,392,899 B1 * 5/2002 Harrison ..... G06F 1/189 361/768
6,523,253 B1 * 2/2003 Harrison ..... G06F 1/183 29/854
6,556,455 B2 * 4/2003 Dibene, II ..... H01R 12/7088 257/E23.09
6,847,529 B2 * 1/2005 Dibene, II ..... H05K 7/1092 257/E23.09
7,248,481 B2 7/2007 Trobough
7,281,866 B2 * 10/2007 Zhang ..... G06F 1/26 703/23
11,100,034 B1 * 8/2021 Vispute ..... G06F 1/266
2002/0057554 A1 * 5/2002 Dibene, II ..... G06F 1/182 361/720
2002/0172022 A1 * 11/2002 DiBene, II ..... H01R 12/7088 257/E23.09
2003/0057548 A1 * 3/2003 Hartke ..... H01R 4/64 257/718
2003/0156400 A1 * 8/2003 Dibene, II ..... H01R 12/7088 257/E23.09
2003/0162442 A1 * 8/2003 Panella ..... H05K 1/0262 439/607.05
2003/0181075 A1 * 9/2003 Hartke ..... H05K 1/141 439/67
2003/0194832 A1 * 10/2003 Lopata ..... H05K 7/1092 257/E23.079
2004/0027813 A1 * 2/2004 Li ..... H05K 1/0231 257/E23.079
2004/0124511 A1 * 7/2004 Li ..... H05K 1/0212 257/678
2005/0207131 A1 * 9/2005 Prokofiev ..... H05K 7/1092 257/E23.079
2005/0230841 A1 * 10/2005 Walk ..... H01L 23/49827 257/737
2005/0248024 A1 * 11/2005 Costello ..... H05K 7/1092 257/691
2007/0002519 A1 * 1/2007 Li ..... H01G 4/30 361/303
2007/0070673 A1 * 3/2007 Borkar ..... H01L 25/0657 365/63
2009/0088008 A1 4/2009 Bandholz et al.
2009/0322414 A1 * 12/2009 Oraw ..... H02M 3/07 327/537
2012/0166113 A1 6/2012 Pettersen et al.
2018/0118174 A1 * 5/2018 Moskowitz ..... B60L 50/66
2019/0006331 A1 * 1/2019 Khalaf ..... H01L 25/50
2019/0221345 A1 * 7/2019 Vadlamani ..... H01L 21/56
2021/0307189 A1 * 9/2021 Lucero ..... G06F 15/78

OTHER PUBLICATIONS

"International Application Serial No. PCT/CN2018/093794, Written Opinion dated Mar. 29, 2019", 4 pgs.

* cited by examiner

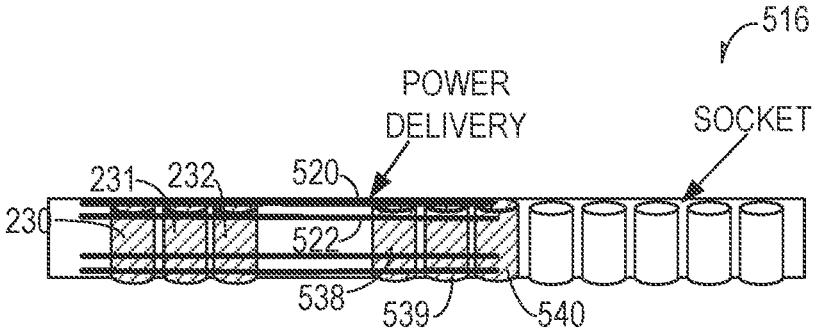
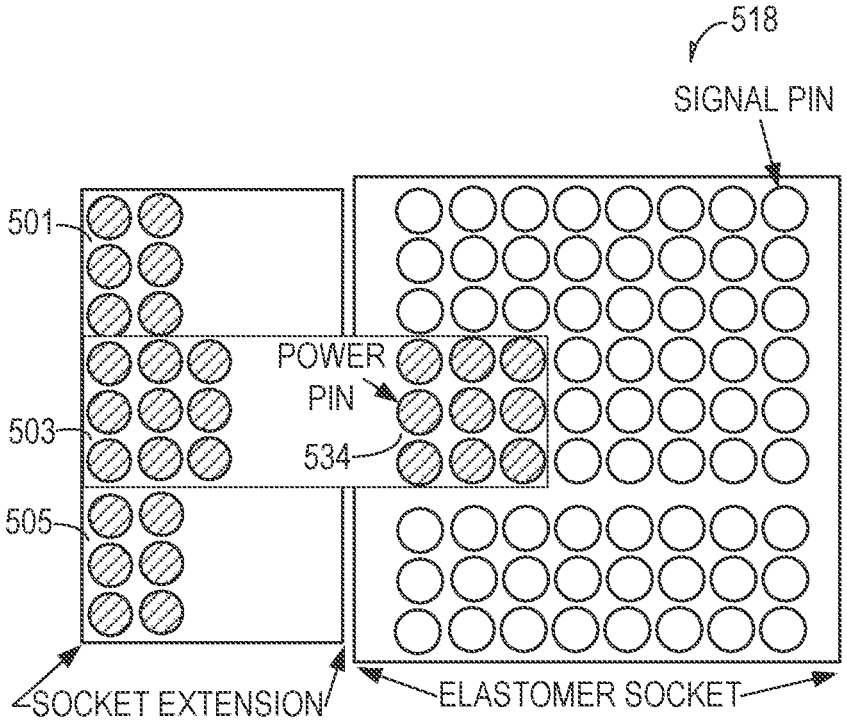
FIG. 5G

HYBRID SOCKET FOR HIGHER THERMAL DESIGN POINT PROCESSOR SUPPORT

This application is a U.S. National Stage Filing under 35 U.S.C. 371 from International Application No. PCT/CN2018/093794, filed on Jun. 29, 2018, and published as WO2020/000413 A1 on Jan. 2, 2020, which application is incorporated herein by reference in its entirety.

TECHNICAL FIELD

The disclosure herein relates generally to hybrid socket structures for power delivery to high thermal design point processors.

BACKGROUND

Power delivery of higher and higher thermal design point (TDP) processors is becoming one of the biggest challenges for board design in order to support the new and future generation processors. Currently, anew generation of micro server products has already exceeded power delivery capability for both soldered down as well as socketed systems. The gap between power delivery requirements and available power for soldered down systems still can be managed with existing solutions. However, socketed systems demand a new solution to meet power delivery requirements. It is predictable that this challenge will be more obvious and serious in the near future as higher performance server or CPU products are developed. Disclosed herein are new hybrid elastomer socket systems that provide power delivery capability that will meet the power delivery requirements of higher TDP processors.

BRIEF DESCRIPTION OF THE DRAWINGS

FIGS. 5H-5J broadly illustrate an improved socket power delivery system with a voltage regulator placed on the mother board, according to some embodiments.

DETAILED DESCRIPTION

A current solution for the above power delivery gap is to add more layers of printed circuit board (PCB) by adding more layers to board design, which reduces $R_{Path}$ and improves power delivery. However, adding more layers to a board design increases cost of the board itself dramatically. Increasing the layers of design to meet power delivery requirements is at a point that the cost of the product will be too high to stay competitive in the market.

Another solution is by use of socketed systems. Socketed systems are critical for validation purposes but current socketed systems do not meet power delivery requirements for new generation processors. Currently there is no power delivery solution for the highest power versions of expected processors. The path resistance ($R_{Path}$) of current socketed systems is too high to meet requirements, even with more power planes, and the socket itself plays a major role in this problem since the socket alone adds 30 μΩ per pin. A past solution to this problem was to lower the resistance of the socket. Reducing the resistance of the socket improves the power delivery by reducing the $R_{Path}$. On previous products, anew elastomer socket technology was developed to reduce the resistance of the socket with the above result of 30 μΩ per pin contact. FIGS. 1A-1D, discussed below, show the concept of the current socket solution using an elastomer socket of the type developed by ISC International Co. Ltd.

Figure 1A:
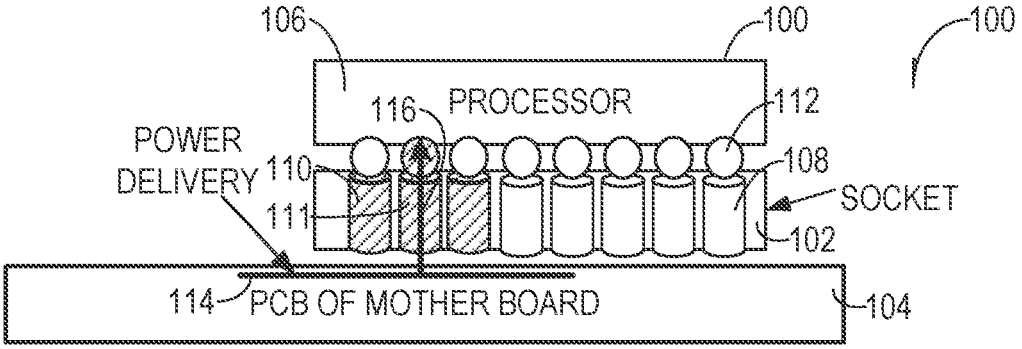
FIGS. 1A-1D broadly illustrate a current socket power delivery system.
Figure 1C:
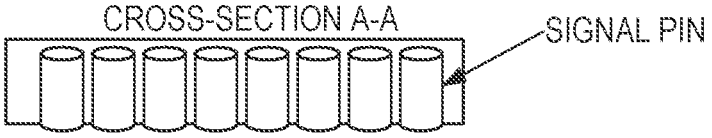
Figure 1D:
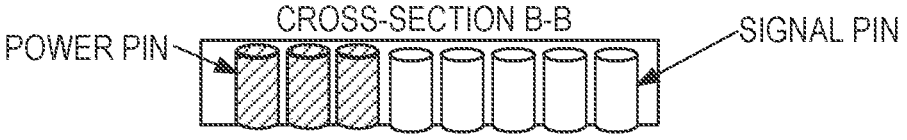
Figure 1B:
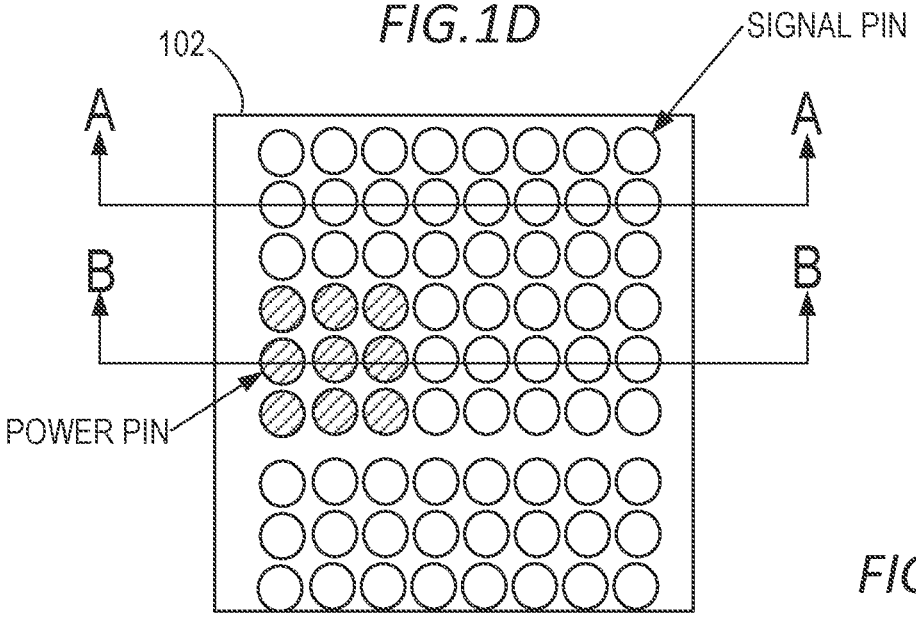

FIGS. 1A-1D broadly illustrate a current socket power delivery system alluded to above. In FIG. 1A, socketed system 100 comprises elastomer socket 102 coupled to motherboard 104 and processor 106. Socket 102 comprises signal pins, indicated by clear cylinders one of which is enumerated 108, and power pins, indicated by cross-hatched cylinders, two of which are enumerated 110, 111. The socket 102 is seen in top view in FIG. 1B, where again, signal pins are in clear format while power pins are in cross-hatched format. The socket pins are connected to the processor by, in some embodiments, solder balls, one of which is enumerated 112 in FIG. 1A and which may be part of a ball grid array (BGA). The connection component is not limited to BGA, but could be a land grid array (LGA) or other suitable connection. Power can be delivered by power delivery plane 114, which may be a conductive level of the PCB of the mother board 104. Power connection from the power plane 114 may be through power pin 111 by way of via 116 or through the any of the other power pins of socket 102. FIG. 1C is a section view A-A, which illustrates the signal pins of the socket 102 of FIG. 1B. FIG. 1D is a section view B-B, which illustrates the signal pins on the socket 102 of FIG. 1B in clear format and the power pins on the socket 102 of FIG. 1B in cross-hatched format.

However, as mentioned above, the socket in the illustrated solution adds additional RPath which makes expected higher TDP processor support difficult and in some instances nearly impossible in the future. With new generation processors there are already gaps with previous solutions. In other words, a lower resistance socket than that described in FIGS. 1A-1D is needed because for new generation processors, the $R_{Path}$ used in previous solutions is too high, since the new processors demand higher current and the $R_{Path}$ must be lower to meet such power delivery requirements.

Figure 2A:
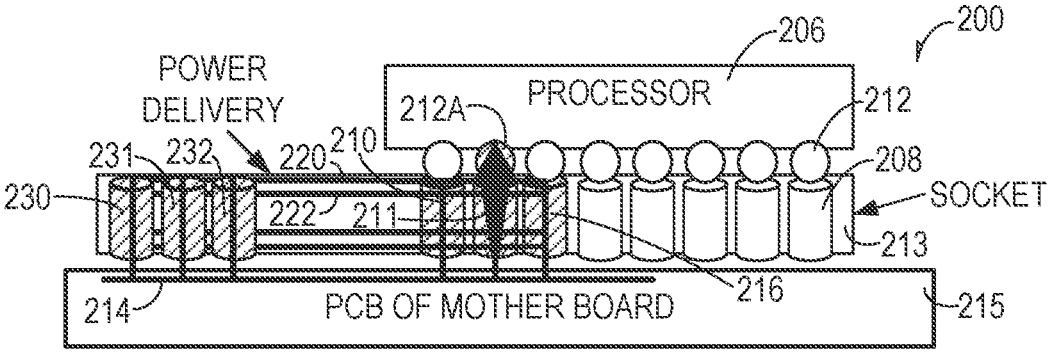
FIGS. 2A-2D broadly illustrate an improved socket power delivery system without a voltage regulator connected to a socket extension, according to some embodiments.
Figure 2C:
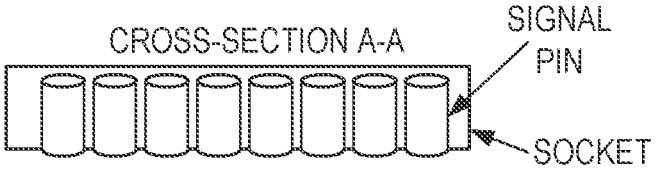
Figure 2D:
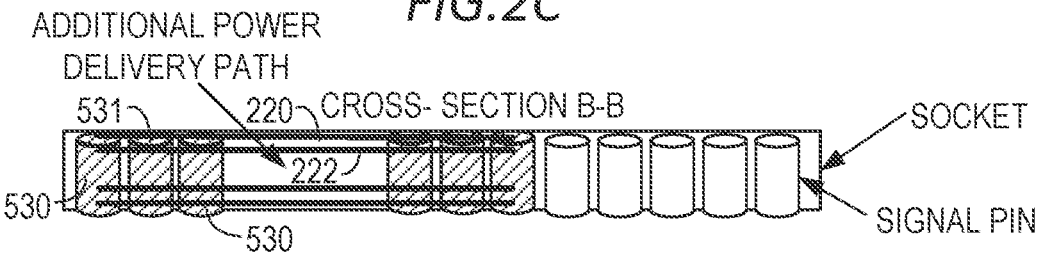
Figure 2B:
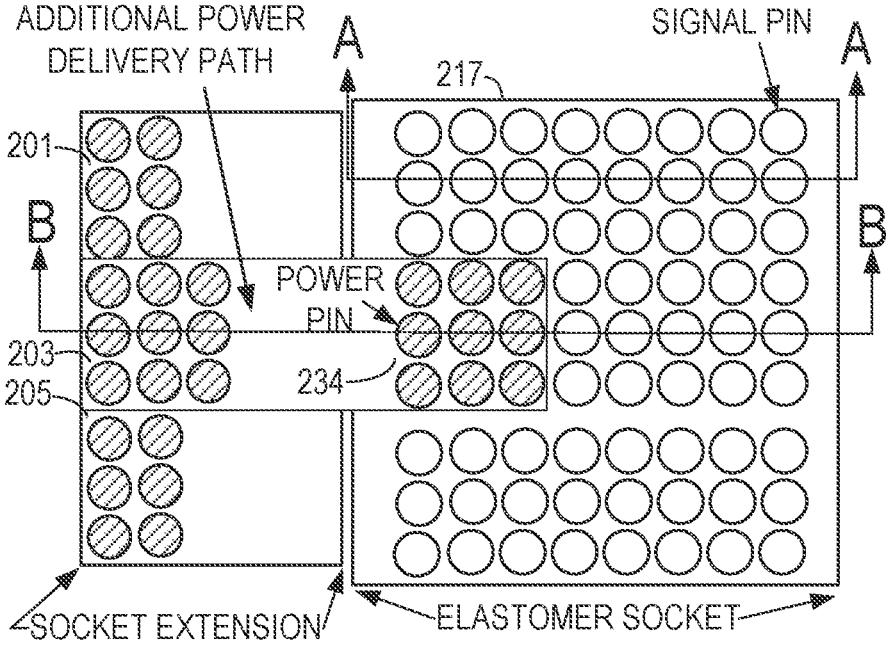

An improved elastomer socket device capable of combining conductive elastomer columns to connect pins from the processor package to the mother board, including power rail pins, is disclosed. Also, power rail pins may be connected directly to the voltage regulator (VR) through an additional power delivery path such as a flexible printed circuit board (PCB) that may be merged into the socket device itself in some embodiments. FIGS. 2A-2D broadly illustrate an improved elastomer socket power delivery system 200, according to some embodiments. FIGS. 2A-2D are essentially the same as FIGS. 1A-1D but with additional power delivery paths, four of which are shown, two of which are enumerated 220, 222, and a socket extension. In some embodiments, a flexible PCBs may be merged into the socket and used for the additional power delivery paths. In FIG. 2A, socketed system 200 comprises socket 213, which is illustrated in additional detail in FIG. 2B as comprising an elastomer socket area and an extended elastomer socket area, coupled to mother board 215 and processor 206. Socket 213 comprises signal pins, indicated by clear cylinders one of which is enumerated 208 and power pins, indicated by cross-hatched power rail pins, two of which are enumerated 210, 211. The socket pins are connected to the processor 206 by, in some embodiments, solder balls, one of which is enumerated 212, which may be part of a BGA. Power can be delivered by power delivery plane 214, which may be a level of the PCB of the mother board 215. The socket 213 is seen in top view in FIG. 2B. For illustration purposes only, there are four groups of power pins: 201, which is a group of six power pins; 203, which is a group of nine power pins, 205 which is a group of six power pins and 234 which is another group of nine power pins, this group of nine, illustrated in side view as power pins 210, 211 and 216 in FIG. 2A, are connected to the processor 206. Groups 201, 203, 205 receive voltage V1 from a power source which may be provided in a number of configurations, according to some embodiments. Some of these configurations are discussed below with respect to FIGS. 5D-5J. Voltage V1 is provided to power pins 201, 203, 205 which are connected to voltage regulator VR located on the mother board or at some other location. Voltage regulator VR regulates its output voltage V2 which is also supplied to power pin group 234. As mentioned above, the power pins in group 234 are connected to the processor to provide required power connections to the processor as illustrated in FIG. 2A as power delivery paths such as 220, 222. The number of power pins, the location of the power pins, and the number of VRs shown are for illustration purposes only. The actual number and location depends on the requirements of the particular implementation. In the case of FIG. 2B, there happen to be the nine power pins that receive power from the VR because the processor illustrated has nine power connection points as illustrated in group 234 of FIG. 2B and the cross section B-B of FIG. 2D, and the side view illustration of FIG. 2A. FIG. 2F, discussed below, illustrates a different configuration of power pins. Further, even FIG. 2F is only one of many additional power pin configurations, the configuration based on the power connections required by the processor FIG. 2C is a cross section A-A view, which illustrates the signal pins on the socket 213 of FIG. 2B. FIG. 2D is a cross section B-B view, which illustrates the signal pins on the socket 213 of FIG. 2B in clear format and the power pins on the socket 213 of FIG. 2B in cross-hatched format. The power rail pins can also be connected directly to a voltage regulator VR of the power source through power p lane 214 on the mother board and additional power delivery paths on the socket seen, in one embodiment, as four horizontal paths in FIG. 2A, two of which are enumerated 220, 222. The $R_{Path}$ is reduced by adding additional power delivery paths for power rails, which keeps signal integrity impact to a minimum. Therefore the disclosed subject matter provides the possibility and flexibility to support higher TDP processors for both processor validation and for product offerings in the future. For example, connecting power rail pins only through horizontal paths in FIG. 2A, two of which are enumerated 220, 222, directly to a voltage regulator VR of the power source reduces $R_{path}$ since there is no socket resistance added. Further, connecting power rail pins directly to the VR via both additional power delivery path(s) and the original socket pin and a power delivery path on the mother board also reduces $R_{path}$. In some embodiments, these additional power delivery paths such as 220, 222 can be copper layers of a flexible printed circuit board merged into the socket device itself, and can deliver increased power. These additional power delivery paths can result in increased power delivery also because of a short path of power delivery, as indicated symbolically by the larger arrow of FIG. 2A for some embodiments, as compared to the smaller-width arrow 116 of FIG. 1A. For example, the power delivery paths such as 220, 222 may each be a power plane connected to the VR, resulting in a shorter delivery path from, in one example, power delivery path 220, to the appropriate power pin such as 216 instead of the longer power delivery path from p lane 214 to power pin 216. If the power requirements of processor 206 are such that they cannot meet the power requirements of processor 206, power delivery path 214, in the mother board, may also be used to provide power. In other words, what is described in a use case in which processor power demand is so high that the demand cannot be not supplied by the illustrated four power delivery paths 220, 222, . . . , Therefore, the power delivery path 214 in the mother board is also used to supply p owe to meet the processor demand.

Figure 3:
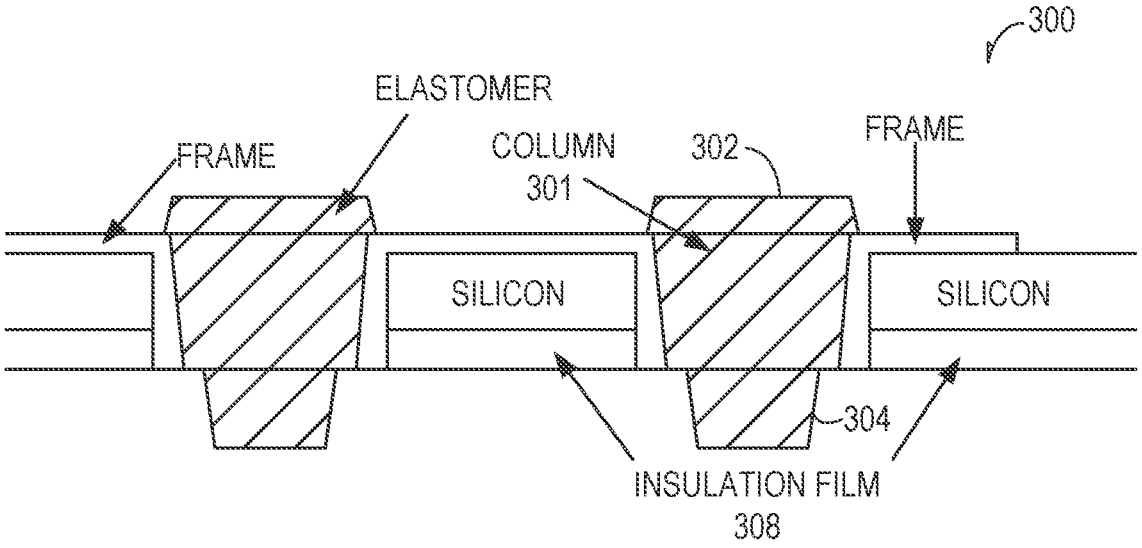
FIG. 3 shows a cross section of an elastomer socket design useful in some embodiments.

FIG. 3 shows a cross section of an elastomer socket design 300 useful in some embodiments. The socket contains elastomer columns surrounded by a frame that is within an appropriate silicon body, with an insulation film surrounding the columns, as illustrated. The elastomer columns are filled with metal particles that are capable of conducting electric signals when a force is applied on top 302 of the column. Bottom 304 can be connected to an appropriate point on a mother board (not shown), in some embodiments. In some embodiments, openings may be implemented at various levels of the frame to enable one or more copper planes of a PCB, such as a flexible PCB in some embodiments, to be connected to the columns.

Figure 4A:
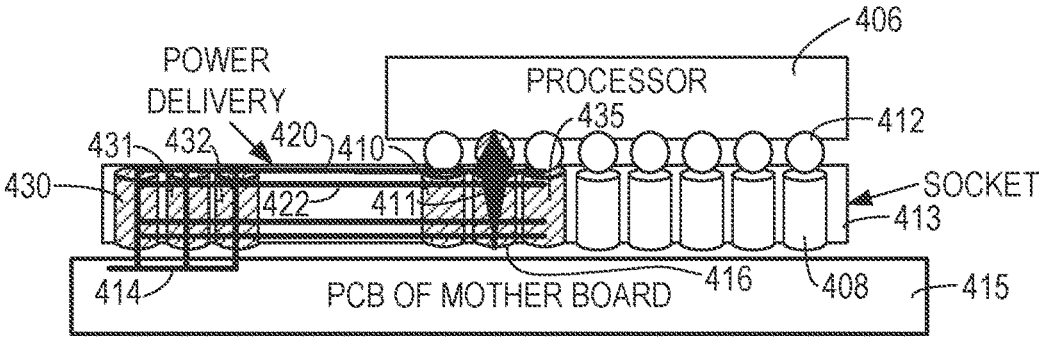
FIGS. 4A-4D broadly illustrate another improved power delivery system without a voltage regulator connected to a socket extension, according to some embodiments.
Figure 4C:
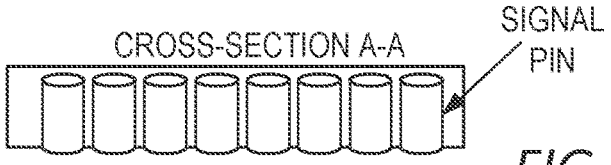
Figure 4D:
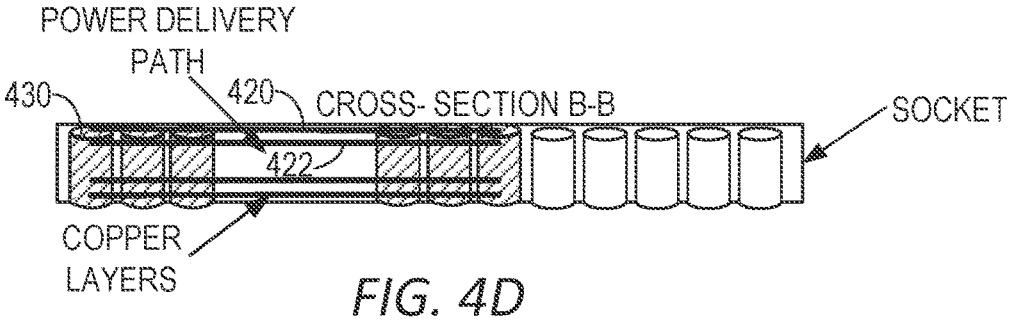
Figure 4B:
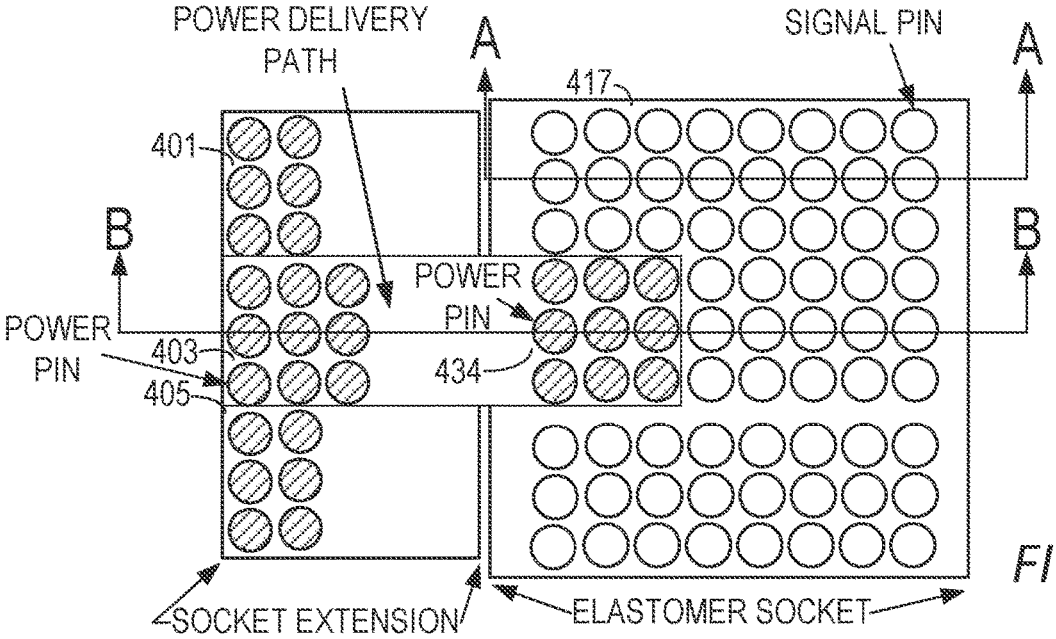

FIGS. 4A-4D broadly illustrate another improved socket power delivery system, according to some embodiments. FIGS. 4A-4D are essentially the same as FIGS. 2A-2D but illustrates a use case where the socket power delivery paths, two of which are enumerated 420, 422, can supply the power demanded by the processor 406. In other words, the power delivered to the power pins 410, 411, 435, and then to processor 406, does satisfy processor power demand, and therefore power path 414 in the mother board does not need to be used to supply power to power pins 410, 411, 435. This is unlike the use case illustrated in FIGS. 2A-2A where power delivery path 214 in the motherboard is needed, in addition to the power delivery paths in the socket, to meet processor power demands, via power pins 210, 211, 216. As discussed above for FIGS. 2A-2D and also here for FIGS. 4A-4D, a flexible PCB may be used for the power delivery paths A flexible PCB is made of insulation film internal to the PCT and has copper films on a single layer or on multiple layers, to provide high power delivery capability. In FIG. 4A, socketed system 400 comprises socket 413 coupled to mother board 415 and processor 406. Socket 413 comprises signal pins, indicated by clear cylinders one of which is enumerated 408 and power pins, indicated by cross-hatched power rail pins, two of which are enumerated 410, 411. The socket pins are connected to the processors by, in some embodiments, solder balls, one of which is enumerated 412, which may be part of a BGA. Power can be delivered by power delivery p lane 414, which may be a level of the PCB of the mother-board 415. The socket 413 is seen in top view in FIG. 4B. As in FIG. 2B, there are four group s of power pins, 401, 403 and 405. Group 434 are power pins that are connected to processor 406 much the same way as explained for group 234 of FIG. 2B. FIG. 4C is a cross section A-A view, which illustrates the signal pins on the socket 413 of FIG. 4B. FIG. 4D is a cross section B-B view, which illustrates the signal pins on the socket 413 of FIG. 4B in clear format and the power pins on the socket 413 of FIG. 4B in cross-hatched format.

FIG. 4D shows a cross section of the Flexible PCB with multiple copper power delivery paths. A flexible PCB may have a different connection from top to bottom depending on the type of pin being used. The connection between a power delivery path and a VR can be designed depending on actual requirements. In some embodiments, for a VR on the power delivery path like a flexible PCB, connection can be via a connector, the connection can be via direct soldering or the connection can be via by a lock device, among other examples.

For pins that are to be connected to the mother board through an elastomer column, there are p ads on top and on the bottom, which may be a power plane, with bias making the connection between them, according to some embodiments, as discussed further below with respect to FIGS. 6 and 7. For the voltage rail that will go through the flexible PCB without going through the elastomer column, there will be pads on the top side and the bottom side will be a power p lane, in some embodiments, with bias to connect the top p ad to the mother board as discussed below with respect to FIG. 6. For a current power delivery path connection, layers of flexible PCB in some embodiments may provide another power delivery path as discussed above with respect to FIGS. 2A and 2B. A power supply rail, or voltage rail, refers to a single voltage provided by a power supply unit.

Figure 4E:
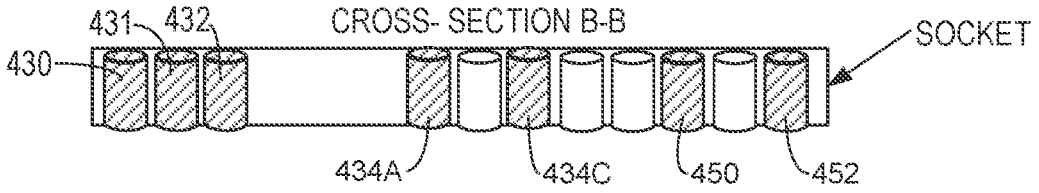
FIGS. 4E-4F broadly illustrate a third improved power delivery system without a voltage regulator connected to a socket extension, according to some embodiments.
Figure 4F:
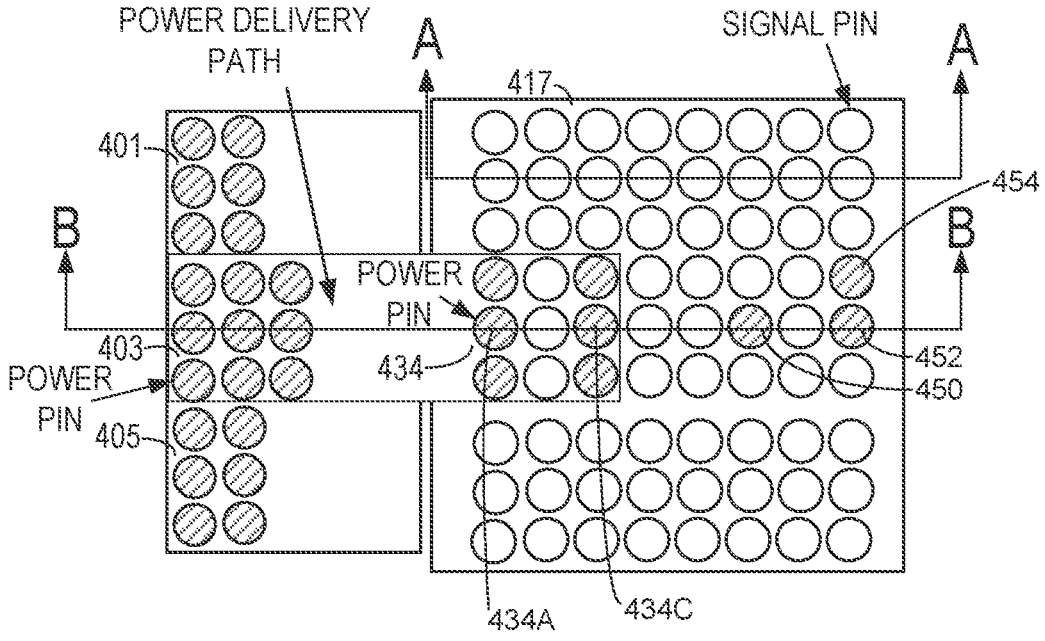

FIGS. 4E-4F broadly illustrate a third improved power delivery system, according to some embodiments. FIGS. 4E-4F illustrate the fact that the power pins can be placed in any configuration that meets the requirements of processor connection points. In FIG. 4F it is seen that the power pin group 434 is a six power pin group, with pins 434A and 434C illustrating two of the power pins. Power pins are also configured at 450, 452, 454. The cross section of FIG. 4E illustrates the power pins 430, 431, 432 from power pins group 403, which may be the same as in FIGS. 4A-4D. A cross section of the power pins 434A, 434C, 450, and 452 are illustrated. The power pin group 434, and power pins 450, 452, 454 match the power connections, such as solder ball points of connection, of a processor such as processor 406 in FIG. 4A (not shown in FIGS. 4E-4F due to space limitations).

Figure 5A:
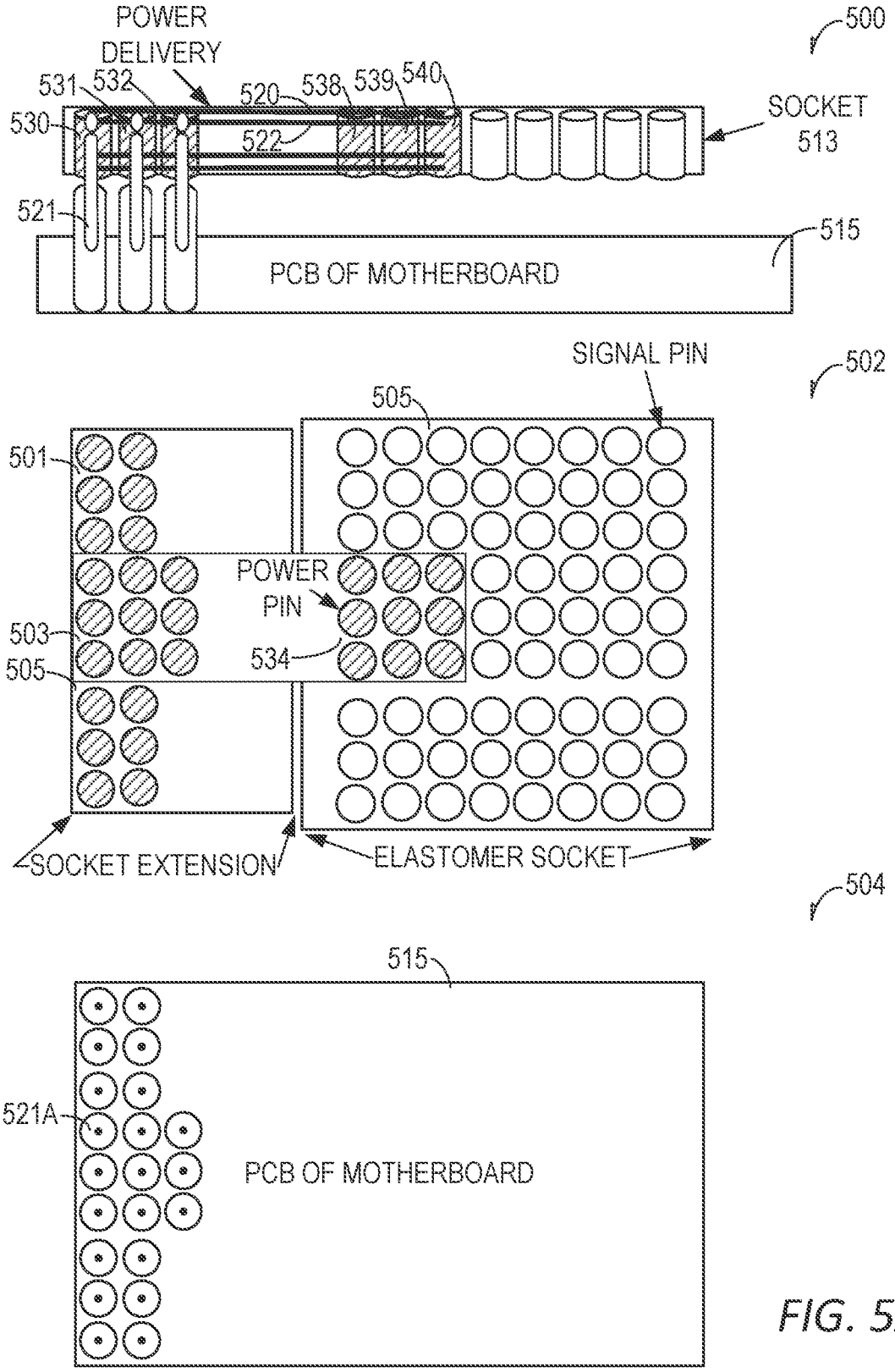
FIGS. 5A-5C broadly illustrate connections to a voltage regulator from a socket extension, according to some embodiments.
Figure 5B:
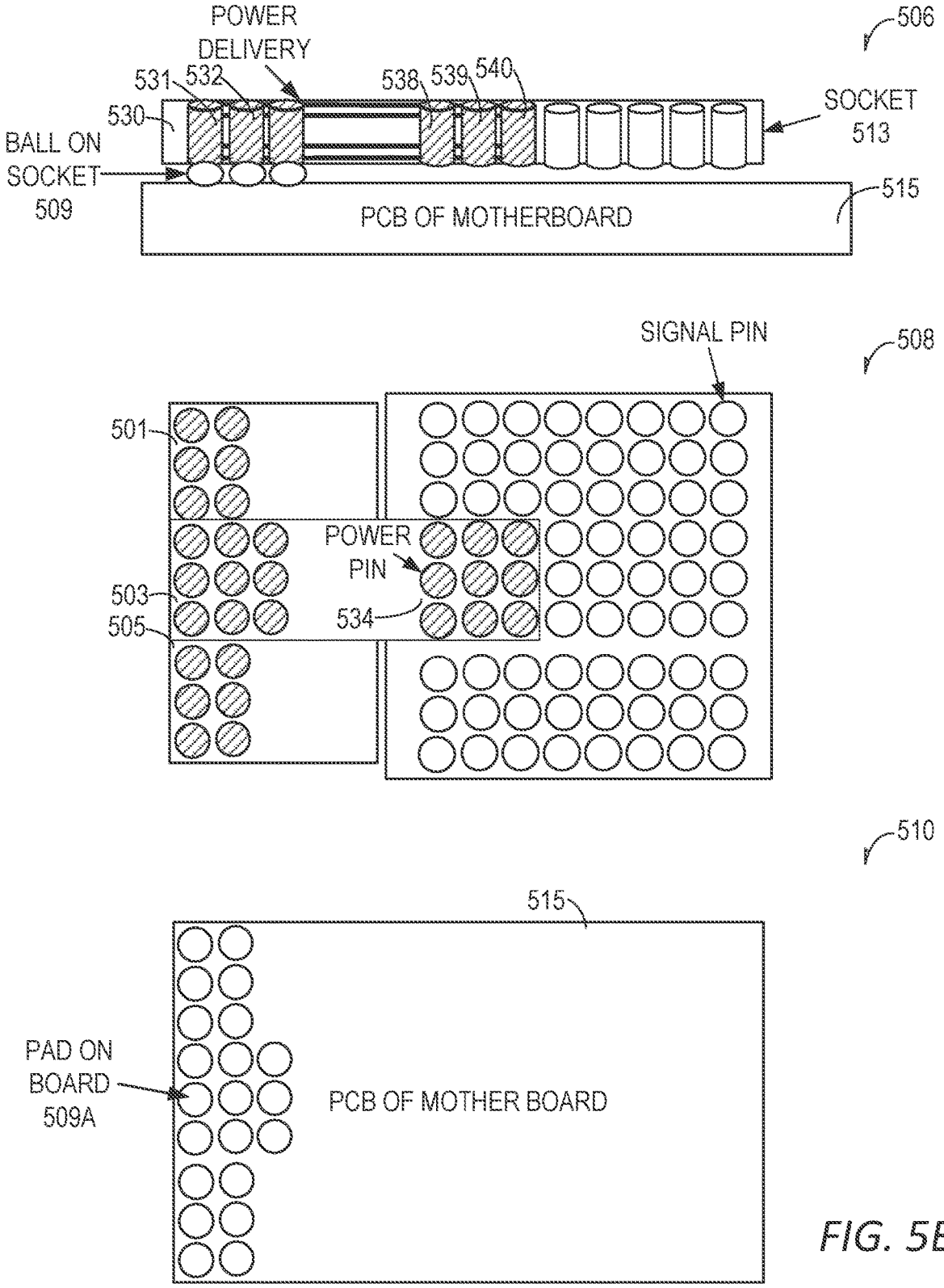
Figure 5C:
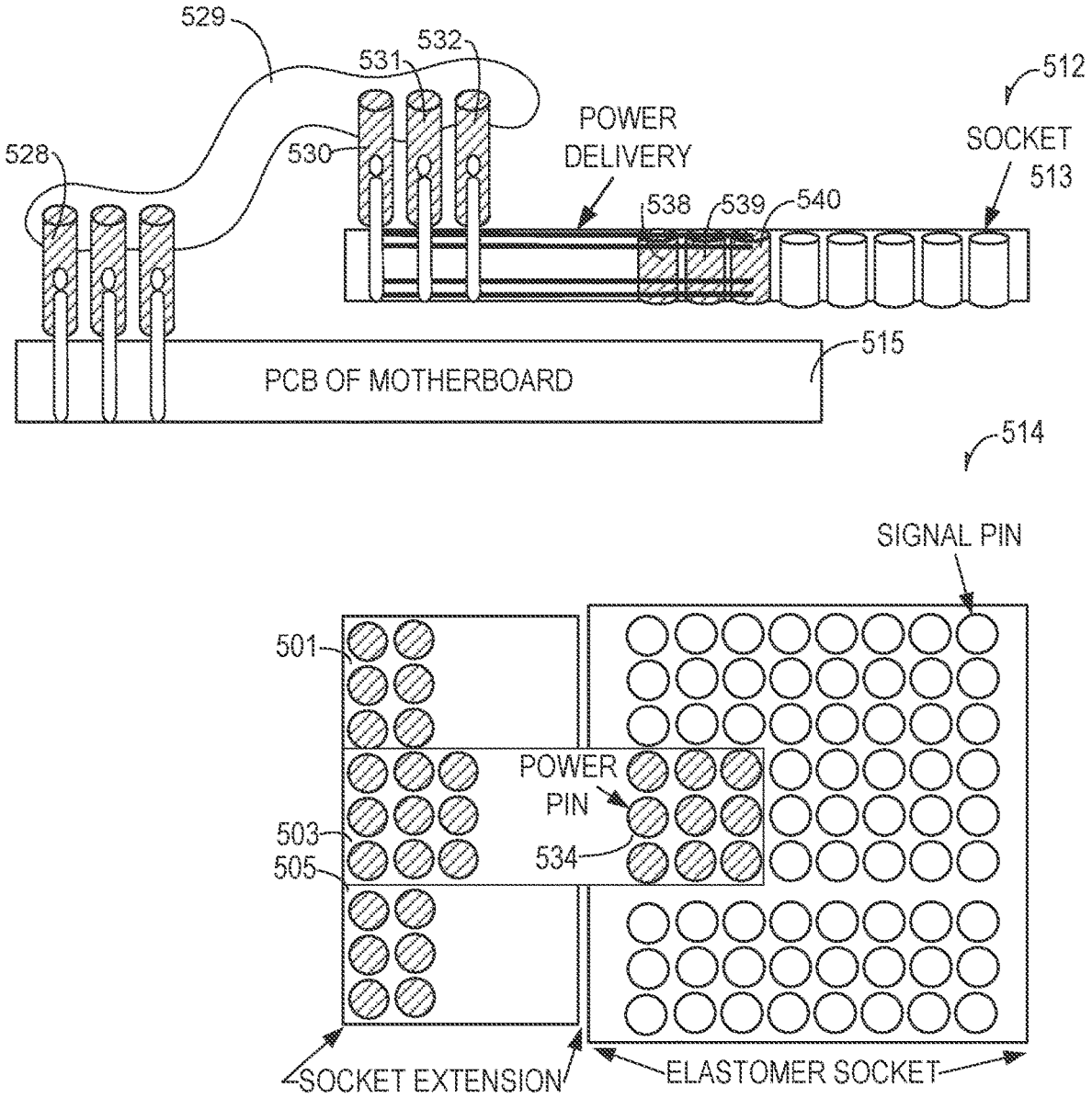

FIGS. 5A-5C broadly illustrate connections to a voltage regulator according to some embodiments. FIG. 5A illustrates connections where the VR is on the mother board as discussed with respect to FIG. 5H, according to some embodiments. The power delivery paths on the socket are connected to the board through connectors such as 521. Through-hole connectors such as 521A are used as example connectors but the disclosed subject matter is not limited to through-hole connectors only. The voltage regulator may be on the board. While not illustrated in FIG. 5A, nor in FIGS. 5B-5D, a hardware processor such as 206 in FIG. 2A or 406 of FIG. 4A is connected to the top of the pins of socket 513 by surface mount elements such as a BGA, according to some embodiments.

FIG. 5B illustrates another example of connections where the VR is on the board. The power delivery path on the socket is connected to the board through direct contact in some embodiments. Solder ball to pad 509,509A is used as an example but the disclosed subject matter is not limited to ball to pad connection only. The voltage regulator is placed on the board as discussed with respect to FIG. 5H, according to some embodiments.

FIG. 5C illustrates yet another example of connections where the VR is on the board. The power delivery path on the socket is connected to the board through a cable or flexible PCB 529 from pins such as 528 to pins such as 530, 531, 532. Cable may also used as an example but the disclosed subject matter is not limited to cable only. The voltage regulator is placed on the board as discussed with respect to FIG. 5H, according to some embodiments.

Figure 5D:
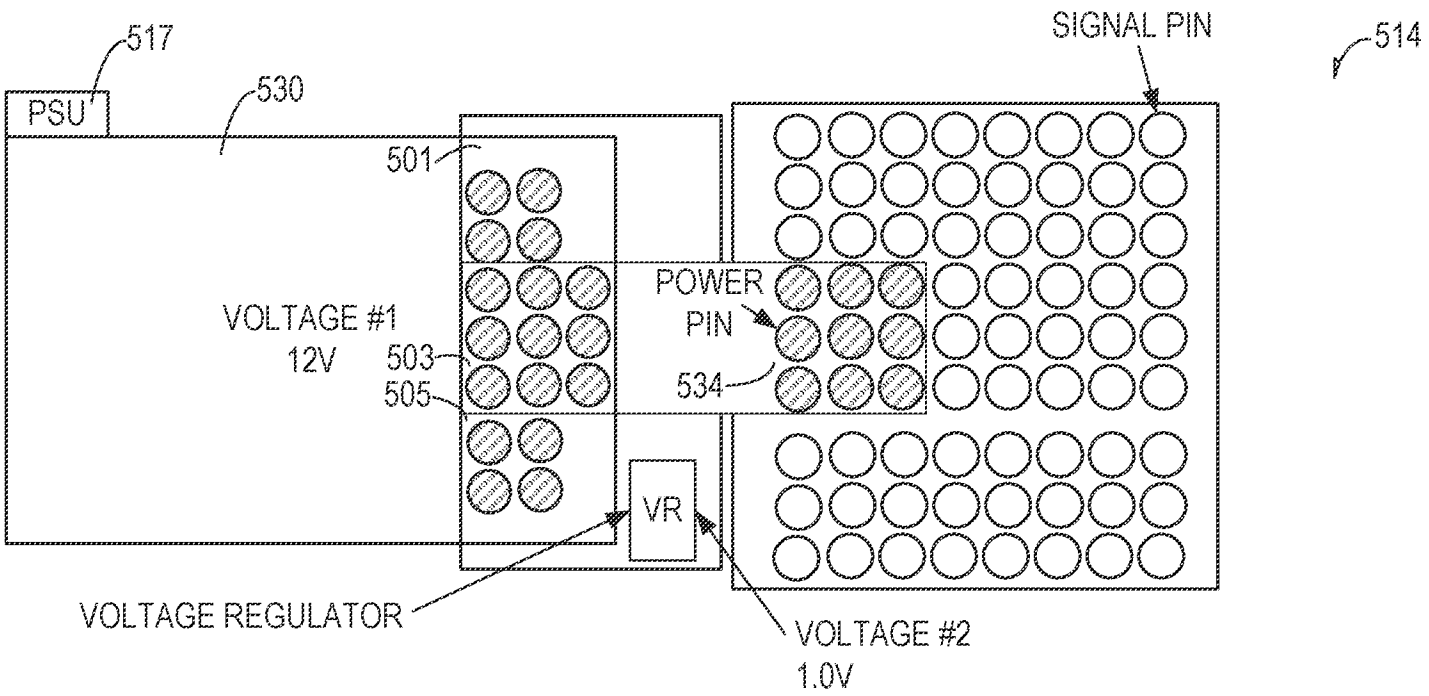
FIG. 5D illustrates one connection to the voltage regulator on the socket extension, according to some embodiments.

FIG. 5D illustrates the connections to the voltage regulator of FIGS. 2A-2D and 4A-4F in greater detail, according to some embodiments. FIG. 5D illustrates an example of connections where the VR is on the socket. In some embodiments the VR may be within the socket extension. The power delivery path on the socket is connected to the board or the PSU 517 through a direct or indirect connection and supplies input voltage V1 which may be 12 volts. Voltage regulator VR regulates output voltage V2 which may be 1.0 volts. Cable 530 used as an example but the disclosed subject matter is not limited to cable only. The voltage regulator VR is connected to power pins such as 530, 531, 532 of FIG. 5B as one example that are configured to receive power from cable 530 according to some embodiments.

Figure 5E:
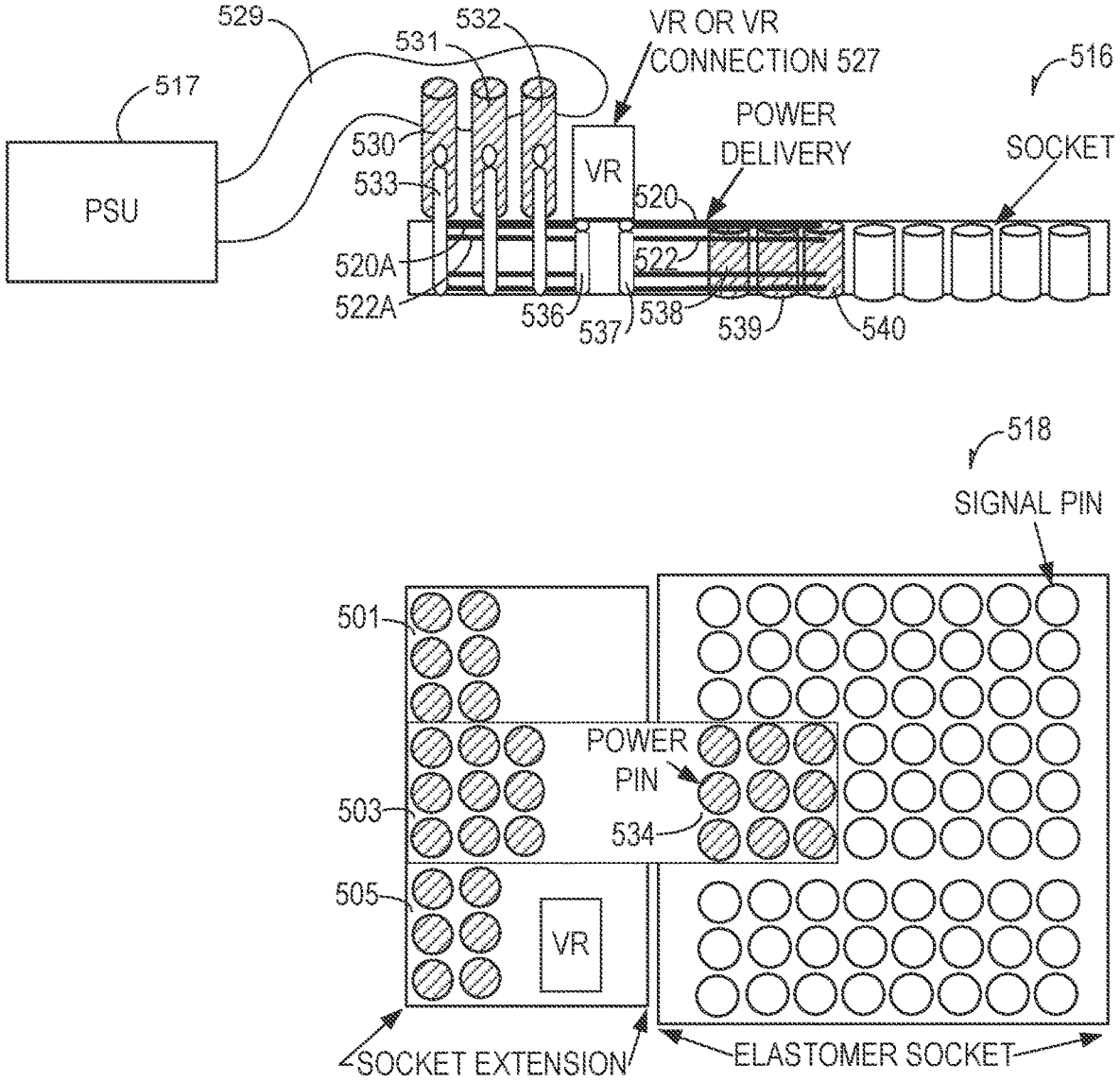
FIG. 5E-5F illustrates the connections of FIG. 5D in additional detail, according to some embodiments.

FIG. 5E illustrates the connections of FIG. 5D in additional detail, according to some embodiments. Power pins such as 530, 531, 532, which are a cross section of pin group 501, 502, 503 and which may be connected to a power supply unit 517 by, in some embodiments, a flexible PCB 529. These power pins 530, 531, 532 may be connected by connectors such as 533 to power delivery lines or planes, two of which are enumerated 520A, 522A. These power delivery lines are connected to the VR located on the socket such as at 527, by vias such as 536,537. The VR is then similarly connected to power delivery lines or planes 520, 522 . . . for power delivery by way of power pins in group 534, seen in cross section at 538, 539, 540, to deliver power as discussed with respect to FIG. 2A-2D or 4A-4D, depending on the use case.

Figure 5F:
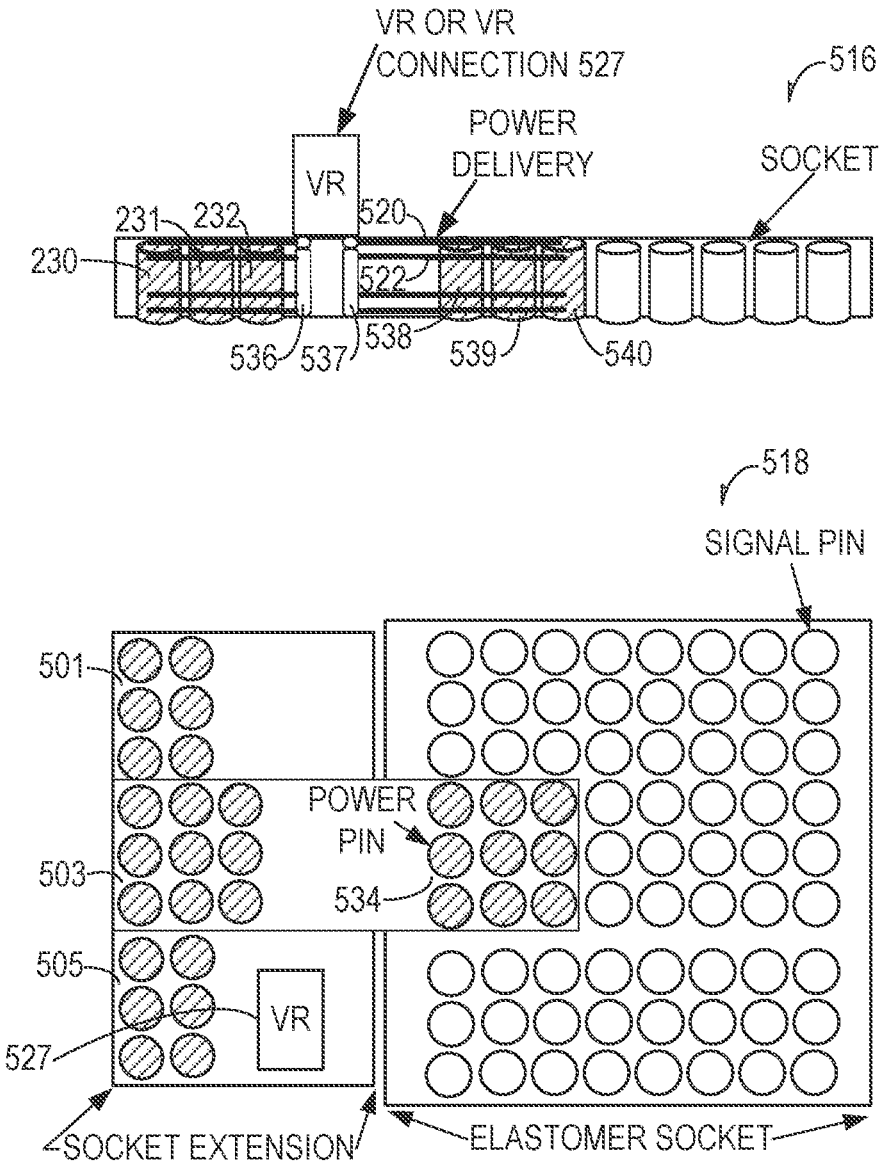

FIG. 5F illustrates FIG. 5E where the pin groups 501, 503,505 and pin group 534 are disconnected, according to some embodiments. In this case, The VR will be on the socket as illustrated at 527 in the top view 518, and in the side view 516, of FIG. 5F. The top view 518 of FIG. 5F illustrates that the VR 527 is located between pin groups 501, 503, 505 and pin group 534. In this embodiment the VR will receive power from the pin groups 501, 503, 505 and supply power received from PSU 517 to pin group 534. Power is supplied to the processor via pin group 534, which is seen in side view 516 as power pins 538, 539, 340 which will connected to the processor by connectors, which in some embodiments may be solder balls, although the connectors are not limited to solder balls.

FIG. 5G illustrates FIG. 5E where the additional power delivery paths, two of which are enumerated 520, 522 in the top view 516, are solidly connected. In other words, sections of each power path are not connected via the VR 527 as in FIG. 5F. In the embodiment of FIG. 5G the VR will not be on the socket but would be located elsewhere such as on the mother board or at another location. In this embodiment there is a direct connection between pin groups 501, 503, 505 and pin group 534. Pin groups 501, 503, 505 will receive power from the VR which is not on the socket. Pin group 534, seen in side view 516 as power pins 538, 539, 540, will then directly supply power to the processor.

Figure 5H:
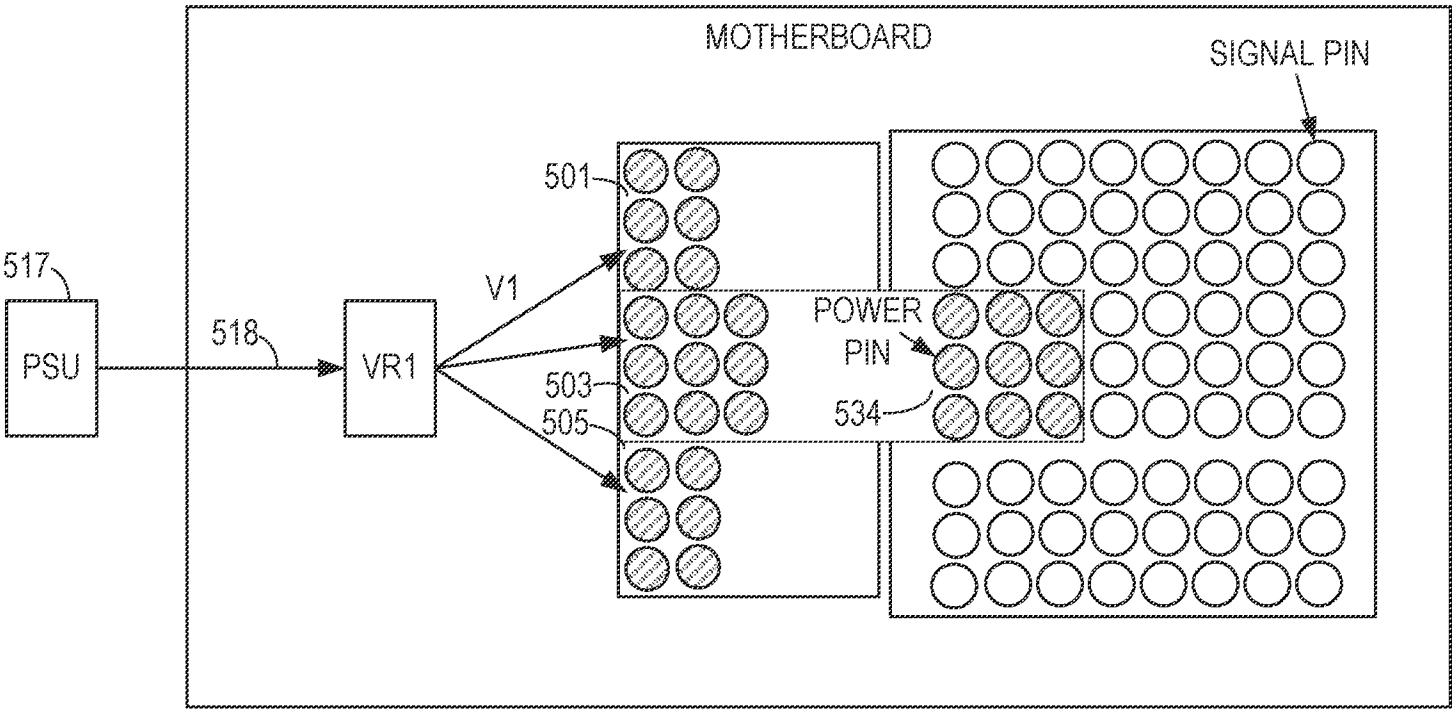
Figure 51:
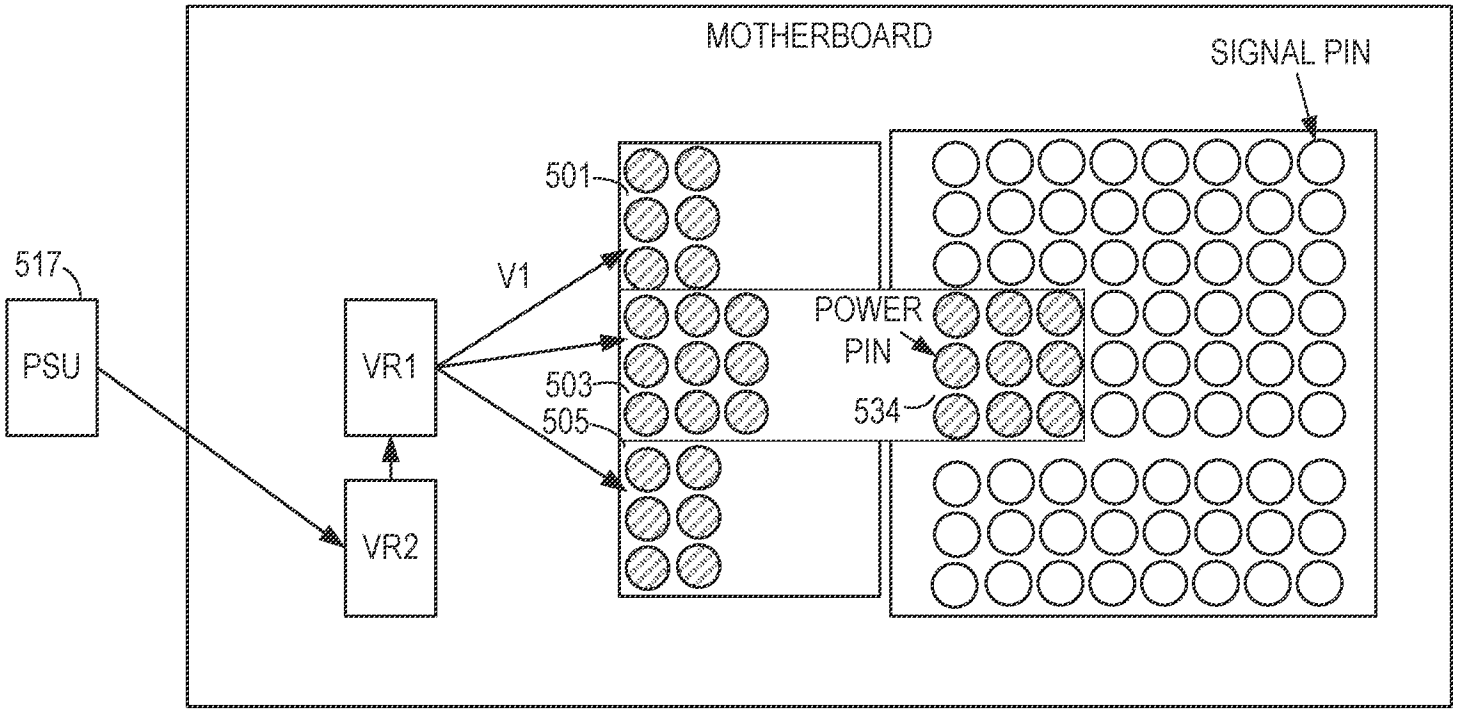
Figure 5J:
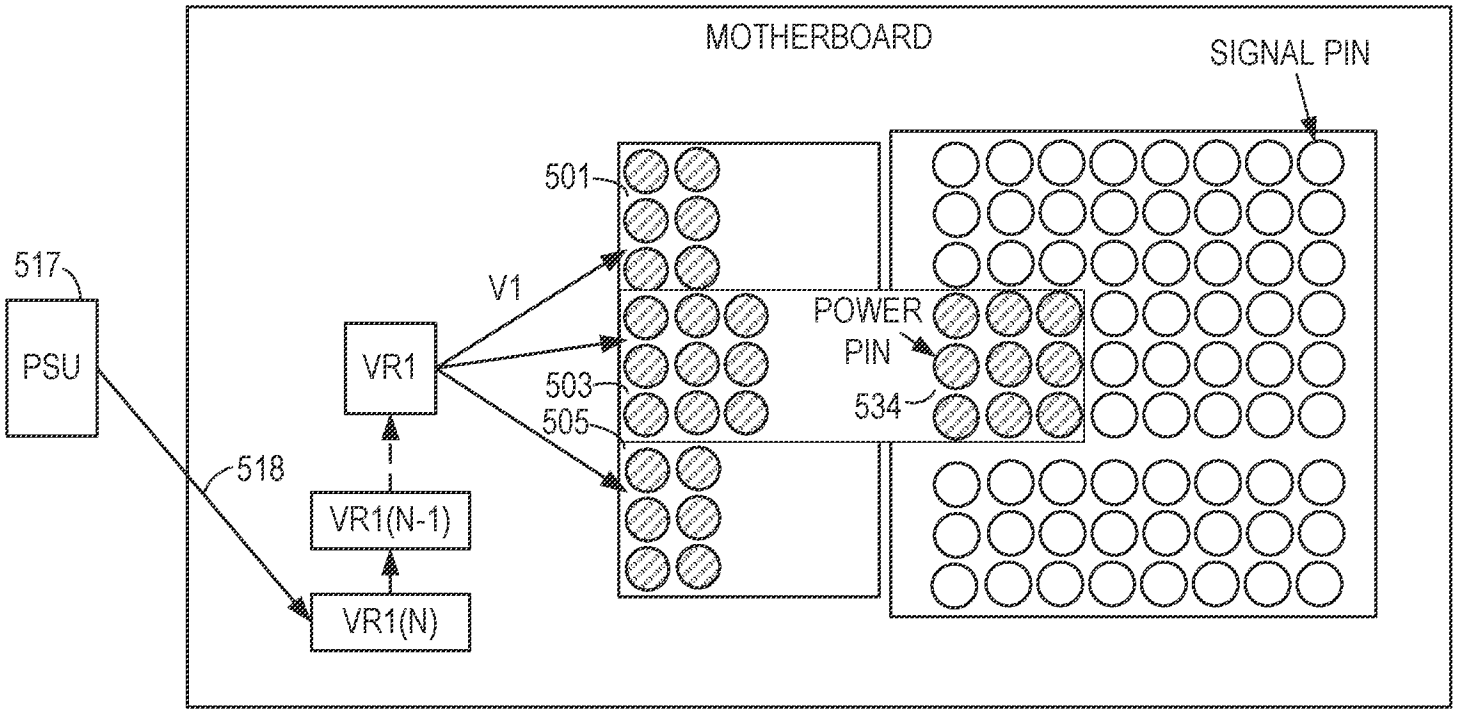

FIGS. 5H-5J broadly illustrate an improved socket power delivery system with a voltage regulator connected to the mother board, according to some embodiments. FIG. 5H illustrates a case where voltage regulator VR1 is located on the mother board, Voltage regulator VR1 receives power from power supply unit 517 over line 518. Voltage regulator VR1 then supplies its voltage, V1, to the power pins on the socket, for example, power pins 501, 503, 505, 534, according to some embodiments, for power delivery as explained above with respect to FIG. 2A-2D or 4A-4D, depending on the use case.

FIG. 5I illustrates the use of two voltage regulators, VR2 and VR 1, located on the mother board. PSU 517 supplies an input voltage to VR2 which supplies its regulated voltage to VR1 which then supplies its regulated voltage, V1, to the power pins in power pin groups 501, 503, 505, for delivery by way of power pin group 534 to meet processor power demand as in FIG. 2A-2D or 4A-4D, depending on the use case.

FIG. 5J illustrates the use of N voltage regulators, VR1(N), VR1(N−1) . . . VR1 wherein VR1(N) is connected to PSU 517. VR1(N) provides its regulated voltage to VR1(N−1) which provides its regulated voltage to the next voltage regulator until VR1 provides its regulated voltage to power pins in power pin groups 501, 503, 505, for delivery by way of power pin group 534 to meet processor power demand as in FIG. 2A-2D or 4A-4D, dep ending on the use case.

Figure 6:
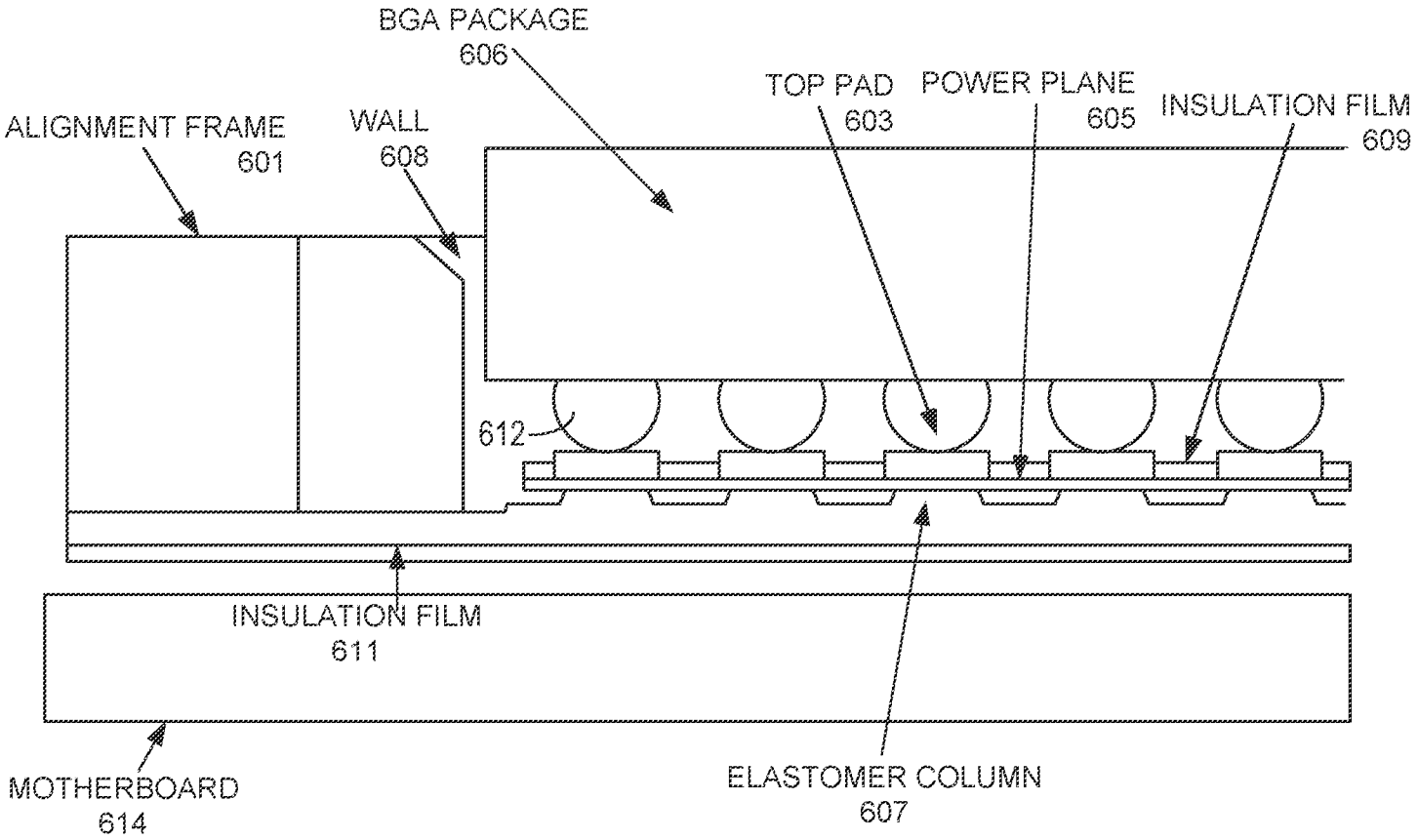
FIG. 6 is a representation of a first voltage rail connection for the improved socket power delivery system, according to some embodiments.

FIG. 6 is a representation of a first voltage rail connection for an improved socket power delivery system of FIGS. 2A-2D, according to some embodiments. FIG. 6 shows the connection for a voltage rail set. The BGA package 406 is connected, by solder balls such as 612, to the top side pad 603 of the power delivery path which, in some embodiments, may be a flexible PCB, using bias to connect to the bottom side, which is power plane 605. The power plane 605 goes out from the socket area and connects directly to the voltage regulator. Elastomer columns such as 607 have only the top side 603 on the set of pins. The elastomer socket has insulation films 609, 611 which may be made of Kapton. The alignment frame 601 aligns the columns such as 607 of the socket to the pad on the board using a standard alignment pin and hold assembly. The frame has walls 608 that hold the socket in order to mount the BGA package 606 to allow the package to be aligned on top of the mother board 614 for connection to outside the PCB. The frame also aligns the processor such as 606 of FIG. 4 to the columns of the socket. In some embodiments, two alignment pins match with two alignment holes, and when alignment pins and alignment holes are matched together, the alignment frame aligns the PCB of the mother board 614, the columns 607 of the socket and the BGA package 606 (or in some embodiments, an LGA package) together. There may be several connection types from top to bottom depending on the type of pin, examples of which were discussed with respect to FIGS. 5A and 5B. The connection between the VR and the power plane may also depend on the type of pin. As discussed above, the socket has both power pins and signal pins. As explained above with respect to FIGS. 2A-2D, the power pins are connected to a power rail. The signal pins are connected only to an elastomer column without going through a power p lane.

Figure 7:
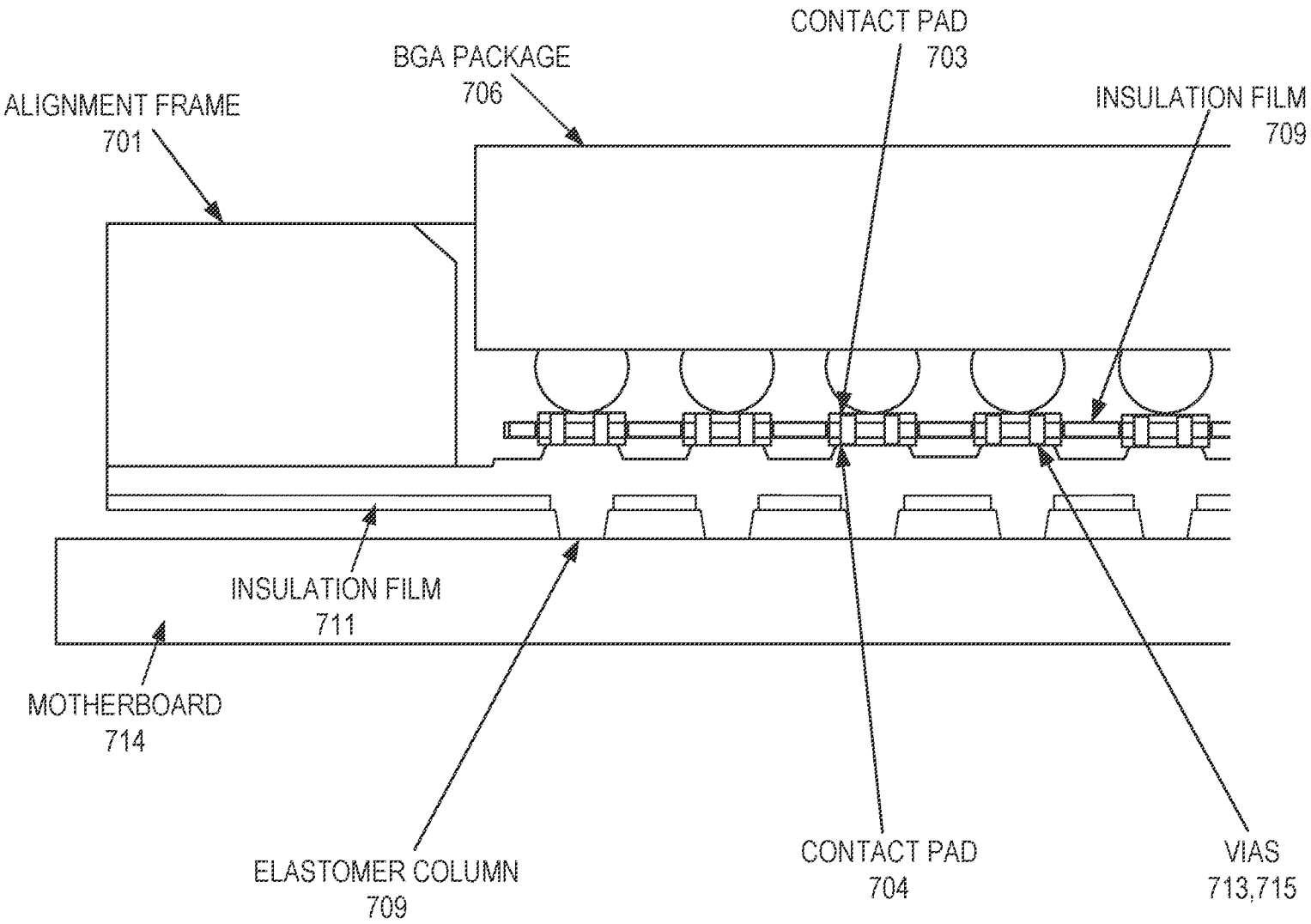
FIG. 7 is a representation of a second voltage rail connection for the improved socket power delivery system, according to some embodiments.
Figure 7A:
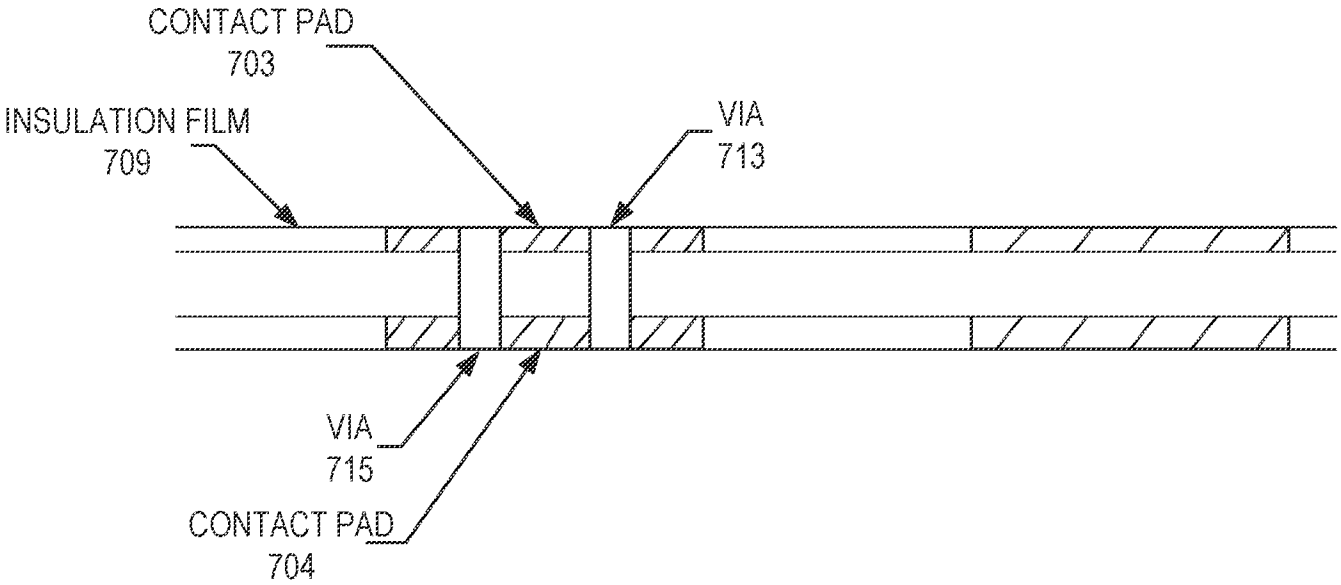
FIG. 7A is a detailed representative of a top pad and a bottom pad for in an improved elastomer socket power delivery system, according to some embodiments.

FIG. 7 is a representation of a second voltage rail connection for an improved socket power delivery system, according to some embodiments. The alignment frame 701 aligns BGA package 706 the columns 709 and the mother board 714 as discussed with respect to FIG. 6. BGA package 706 is connected to the top side p ad 703 of the power delivery path which, in some embodiments, may be a flexible PCB. Using bias, the top side contact p ad 703 connects to the bottom side pad 704, which connects to an elastomer column and goes to the mother board 714. The power delivery path like the above flexible PCB goes out from the socket area and connects directly to the VR. FIG. 7A is a detailed representative of a top pad and a bottom pad for in an improved elastomer socket power delivery system, according to some embodiments. In FIG. 7A the detail of the contact pads, vias and insulation is clearly illustrated for some embodiments.

In summary, one power delivery path comprises a connection where the BGA or other connectors connect to a column such as 111 in FIG. 1A, and to the board power plane to supply power to the processor. Additional power planes may be added, such as 220, 222 of FIGS. 2A and 2C inside the socket 213 of FIG. 2A. This embodiment comprises power rail 214 in the mother board plus the extra power rails 220, 222 . . . in the socket as well. Another embodiment comprises delivering power only through the socket but not through the mother board, which sends power through the socket and not through the board. This embodiment is seen in FIG. 4A where inside the board is power delivery line 414, that connects to three power pin columns, enumerated 430, 431, 432 for power delivery via power planes 420, 422, . . . , that supply power to power pins, one of which is enumerated 411 and one of which is enumerated 435, each of which power pins go .to the processor 406. The more power planes or power rails or power lines, the more Rpath is reduced and the more improved is the power delivery for meeting the requirements of future processors.

Figure 8:
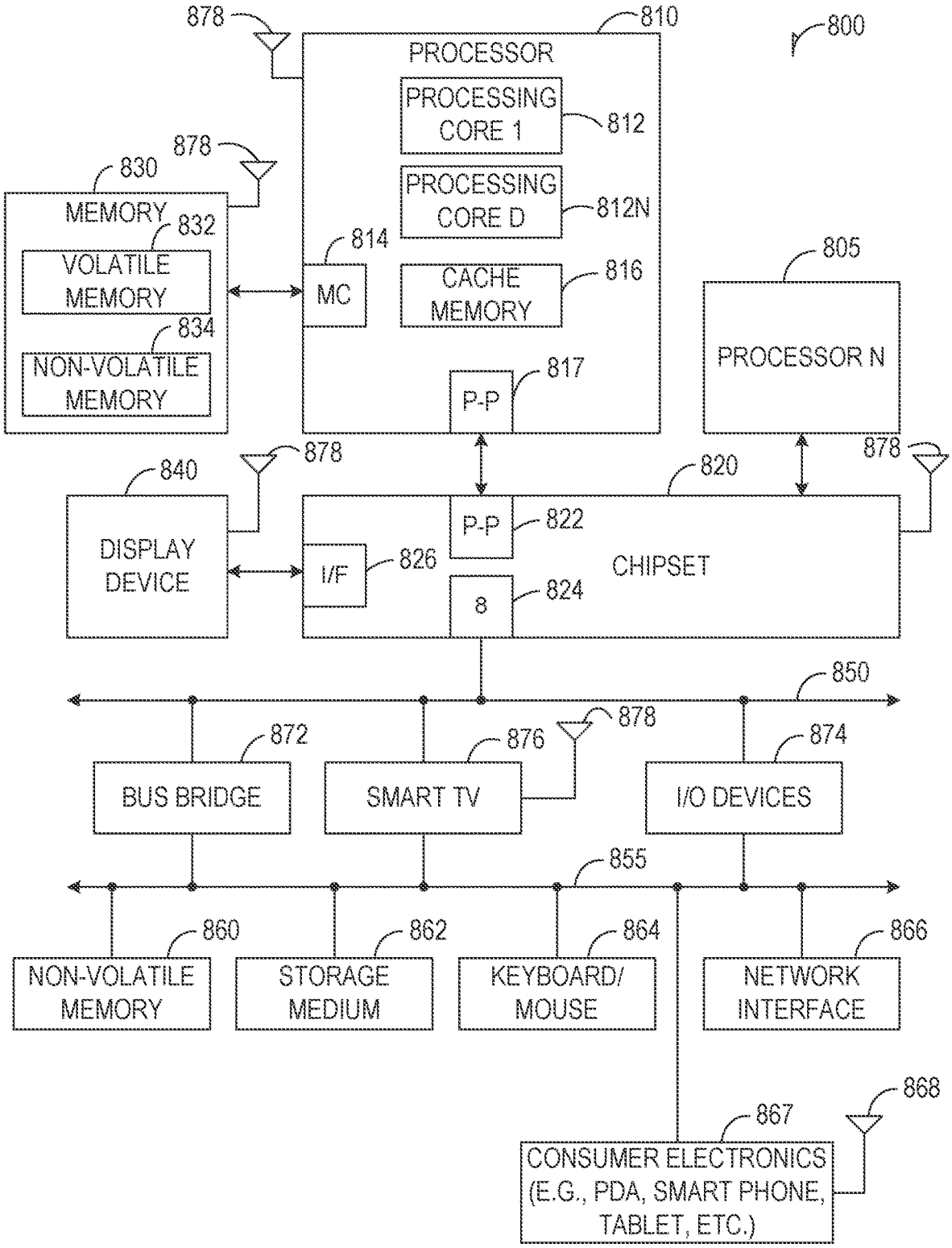
FIG. 8 illustrates a system level diagram depicting an electronic computer system that can include one or more power delivery socket systems as described in the present disclosure, according to some embodiments.

FIG. 8 illustrates a system level diagram depicting an electronic computer system that can include one or more power delivery socket systems as described in the present disclosure, according to some embodiments. FIG. 8 is included to show an example of a higher level device application for integrated circuits employing phase and length matching using slow wave structures. In one embodiment, system 800 includes, but is not limited to, a desktop computer, a laptop computer, a netbook, a tablet, a notebook computer, a personal digital assistant (PDA), a server, a workstation, a cellular telephone, a mobile computing device, a smart phone, an Internet appliance or any other type of computing device. In some embodiments, system 800 is a system on a chip (SOC) system.

In one embodiment, processor 810 has one or more processor cores 812 and 812N, where 812N represents the Nth processor core inside processor 810 where N is a positive integer. In one embodiment, system 800 includes multiple processors including 810 and 805, where processor 805 has logic similar or identical to the logic of processor 810. In some embodiments, processing core 812 includes, but is not limited to, pre-fetch logic to fetch instructions, decode logic to decode the instructions, execution logic to execute instructions and the like. In some embodiments, processor 810 has a cache memory 816 to cache instructions and/or data for system 800. Cache memory 816 may be organized into a hierarchal structure including one or more levels of cache memory.

In some embodiments, processor 810 includes a memory controller 814, which is operable to perform functions that enable the processor 810 to access and communicate with memory 830 that includes a volatile memory 832 and/or a non-volatile memory 834. In some embodiments, processor 810 is coupled with memory 830 and chipset 820. Processor 810 may also be coupled to a wireless antenna 878 to communicate with any device configured to transmit and/or receive wireless signals. In one embodiment, an interface for wireless antenna 878 operates in accordance with, but is not limited to, the IEEE 802.11 standard and its related family, Home Plug AV (HPAV), Ultra Wide Band (UWB), Bluetooth, WiMax, or any form of wireless communication protocol.

In some embodiments, volatile memory 832 includes, but is not limited to, Synchronous Dynamic Random Access Memory (SDRAM), Dynamic Random Access Memory (DRAM), RAMBUS Dynamic Random Access Memory (RDRAM), and/or any other type of random access memory device. Non-volatile memory 834 includes, but is not limited to, flash memory, phase change memory (PCM), read-only memory (ROM), electrically erasable programmable read-only memory (EEPROM), or any other type of non-volatile memory device.

Memory 830 stores information and instructions to be executed by processor 810. In one embodiment, memory 830 may also store temporary variables or other intermediate information while processor 810 is executing instructions. In the illustrated embodiment, chipset 820 connects with processor 810 via Point-to-Point (PtP or P-P) interfaces 817 and 822. Chip set 820 enables processor 810 to connect to other elements in system 800. In some embodiments of the example system, interfaces 817 and 822 operate in accordance with a PtP communication protocol such as the Intel® QuickPath Interconnect (QPI) or the like. In other embodiments, a different interconnect may be used.

In some embodiments, chipset 820 is operable to communicate with processor 810, 805N, display device 840, and other devices, including a bus bridge 872, a smart TV 876, I/O devices 874, nonvolatile memory 860, a storage medium (such as one or more mass storage devices) 862, a keyboard/mouse 864, a network interface 866, and various forms of consumer electronics 877 (such as a PDA, smart phone, tablet etc.), etc. In one embodiment, chipset 820 couples with these devices through an interface 824. Chip set 820 may also be coupled to a wireless antenna 878 to communicate with any device configured to transmit and/or receive wireless signals.

Chipset 820 connects to display device 840 via interface 826. Display 840 may be, for example, a liquid crystal display (LCD), a plasma display, cathode ray tube (CRT) display, or any other form of visual display device. In some embodiments of the example system, processor 810 and chipset 820 are merged into a single SOC. In addition, chip set 820 connects to one or more buses 850 and 855 that interconnect various system elements, such as I/O devices 874, nonvolatile memory 860, storage medium 862, a keyboard/mouse 864, and network interface 866. Buses 850 and 855 may be interconnected together via a bus bridge 872.

In one embodiment, mass storage device 862 includes, but is not limited to, a solid state drive, a hard disk drive, a universal serial bus flash memory drive, or any other form of computer data storage medium. In one embodiment, network interface 866 is implemented by any type of well-known network interface standard including, but not limited to, an Ethernet interface, a universal serial bus (USB) interface, a Peripheral Component Interconnect (PCI) Express interface, a wireless interface and/or any other suitable type of interface. In one embodiment, the wireless interface operates in accordance with, but is not limited to, the IEEE 802.11 standard and its related family, Home Plug AV(HPAV), Ultra Wide Band (UWB), Bluetooth, WiMax, or any form of wireless communication protocol.

While the modules shown in FIG. 8 are depicted as separate blocks within the system 800, the functions performed by some of these blocks may be integrated within a single semiconductor circuit or may be implemented using two or more separate integrated circuits. For example, although cache memory 816 is depicted as a separate block within processor 810, cache memory 816 (or selected embodiments of 816) can be incorporated into processor core 812.

EXAMPLES

Example 1 is a power delivery system comprising: a hardware processor; a motherboard; a voltage regulator (VR) that provides a voltage for the hardware processor; an elastomer computer socket that connects the mother board to the hardware processor, the elastomer computer socket comprising a plurality of power pins wherein a first set of power pins is connected to the hardware processor by surface mount elements, and a second set of power pins is not connected to the hardware processor by surface mount elements, and wherein the second set of power pins is directly connected to the VR for power; a plurality of electrical power delivery paths within the socket, each of the plurality of power delivery paths configured to deliver power from the second set of power pins to the first set of power pins for power delivery to the hardware processor; and an alignment frame that aligns the hardware processor, the plurality of power pins, and the mother board.

In Example 2, the subject matter of Example 1 optionally includes wherein the alignment frame comprises walls that are configured to hold the socket to align the surface mount elements and the power pins to the mother board.

In Example 3, the subject matter of any one or more of Examples 1-2 optionally include wherein the plurality of electrical power delivery paths is configured to connect the first set of power pins and the second set of power pins and power is delivered solely from the VR to the hardware processor via the plurality of electrical power delivery paths within the socket.

In Example 4, the subject matter of Example 3 optionally includes wherein power is delivered from the second set of power pins to the first set of power pins.

In Example 5, the subject matter of any one or more of Examples 3-4 optionally include wherein the plurality of electrical power delivery paths within the socket is part of a flexible printed circuit board (PCB) that is merged into the socket.

In Example 6, the subject matter of any one or more of Examples 3-5 optionally include wherein the VR is on or in the socket.

In Example 7, the subject matter of any one or more of Examples 3-6 optionally include wherein the VR is on or in the mother board.

In Example 8, the subject matter of Example 7 optionally includes wherein the second set of power pins is connected directly to the mother board.

In Example 9, the subject matter of any one or more of Examples 7-8 optionally include wherein the second set of power pins is connected directly to the mother board by one of pad-on-board connections or through-hole connections.

In Example 10, the subject matter of any one or more of Examples 7-9 optionally include wherein the VR is connected to the second set of power pins by a flexible PCB or a cable.

In Example 11, the subject matter of any one or more of Examples 6-10 optionally include wherein the second set of power pins is connected to a power supply unit, power is provided to the VR via the second set of power pins, and the VR provides power to the hardware processor via the first set of power pins.

In Example 12, the subject matter of Example 11 optionally includes wherein the VR provides power to the first set of power pins byway of the plurality of power paths in the socket.

In Example 13, the subject matter of any one or more of Examples 3-12 optionally include wherein the socket comprises a plurality of elastomer columns, wherein each elastomer column has a top side and a bottom side, and the top side is connected to a pad that connects the surface mount elements to the top side of the elastomer column.

Example 14 is a power delivery system comprising: a hardware processor; a motherboard; a voltage regulator (VR) that provides a voltage for the hardware processor; an elastomer computer socket that connects the mother board to the hardware processor, the elastomer computer socket comprising a plurality of power pins wherein a first set of power pins is connected to the hardware processor by surface mount elements, and a second set of power pins is not connected to the hardware processor by surface mount elements, and wherein the second set of power pins is directly connected to the VR for power; a plurality of electrical power delivery paths within the socket, each of the plurality of power delivery paths configured to deliver power from the second set of power pins to the first set of power pins for power delivery to the hardware processor; a power plane within the mother board, the power plane configured to deliver power directly to the first set of power pins for delivery to the hardware processor; and an alignment frame that aligns the hardware processor, the plurality of power pins, and the mother board.

In Example 15, the subject matter of Example 14 optionally includes wherein each of the plurality of power pins comprises an elastomer column and the alignment frame comprises walls that are configured to hold the socket to align the surface mount elements and the elastomer columns to the mother board.

In Example 16, the subject matter of any one or more of Examples 14-15 optionally include wherein the plurality of electrical power delivery paths is configured to connect the second set of power pins and the first set of power pins and power is delivered to the hardware processor from the VR via the plurality of electrical power delivery paths within the socket, and power is also delivered to the hardware processor via the power p lane within the mother board.

In Example 17, the subject matter of Example 16 optionally includes wherein power is delivered from the second set of power pins to the first set of power pins.

In Example 18, the subject matter of any one or more of Examples 16-17 optionally include wherein the plurality of electrical power delivery paths within the socket is part of a flexible PCB that is merged into the socket.

In Example 19, the subject matter of any one or more of Examples 16-18 optionally include wherein the VR is on or in the socket.

In Example 20, the subject matter of any one or more of Examples 16-19 optionally include wherein the VR is on or in the mother board.

In Example 21, the subject matter of Example 20 optionally includes wherein the second set of power pins is connected directly to the mother board.

In Example 22, the subject matter of any one or more of Examples 20-21 optionally include wherein the second set of power pins is connected directly to the mother board by one of p ad-on-board connections or through-hole connections.

In Example 23, the subject matter of any one or more of Examples 20-22 optionally include wherein the VR is connected to the second set of power pins by a flexible PCB or by a cable.

In Example 24, the subject matter of any one or more of Examples 19-23 optionally include wherein the second set of power pins is connected to a power supply unit, power is provided to the VR via the second set of power pins, and the VR provides power to the hardware processor via the first set of power pins.

In Example 25, the subject matter of Example 24 optionally includes wherein the VR provides power to the first set of power pins by way of the plurality of power paths in the socket.

In Example 26, the subject matter of any one or more of Examples 16-25 optionally include wherein the socket comprises a plurality of elastomer columns, wherein each elastomer column has a top side and a bottom side, the top side is connected to a p ad that connects the surface mount elements to the top side of the elastomer column, and the bottom side of the elastomer column is connected to a power plane within the mother board.

Example 27 is a computer processor comprising: one or more processor cores; memory; a memory controller; and a power delivery system, wherein the power delivery system comprises: a motherboard; a voltage regulator (VR) that provides a voltage for the computer processor; an elastomer computer socket that connects the mother board to the computer processor, the elastomer computer socket comprising a plurality of power pins wherein a first set of power pins is connected to the computer processor by surface mount elements, and a second set of power pins is not connected to the computer processor by surface mount elements, and wherein the second set of power pins is directly connected to the VR for power; a plurality of electrical power delivery paths within the socket, each of the plurality of power delivery paths configured to deliver power from the second set of power pins to the first set of power pins for power delivery to the computer processor; and an alignment frame that aligns the computer processor, the plurality of power pins, and the mother board.

In Example 28, the subject matter of Example 27 optionally includes wherein the plurality of electrical power delivery paths is configured to connect the first set of power pins and the second set of power pins.

In Example 29, the subject matter of any one or more of Examples 27-28 optionally include wherein the power delivery system further comprises a power p lane within the mother board, the power p lane configured to deliver power directly to the first set of power pins for delivery to the computer processor.

In Example 30, the subject matter of Example 29 optionally includes wherein power is delivered to the computer processor from the VR via the plurality of electrical power delivery paths within the socket, the power is also delivered via the power plane within the mother board to the computer processor, and power is delivered from the second set of power pins to the first set of power pins.

In Example 31, the subject matter of any one or more of Examples 27-30 optionally include wherein the plurality of electrical power delivery paths within the socket is part of a flexible printed circuit board (PCB) that is merged into the socket.

Example 32 is a power delivery system comprising: a hardware processor; a mother board; at least one voltage regulator (VR) that provides a voltage for the hardware processor, the at least one VR located on or in the mother board; an elastomer computer socket that connects the mother board to the hardware processor, the elastomer computer socket comprising a plurality of power pins wherein a first set of power pins is connected to the hardware processor by surface mount elements, and a second set of power pins is not connected to the hardware processor by surface mount elements, and wherein the second set of power pins is directly connected to the at least one VR for power; a plurality of electrical power delivery paths within the socket, each of the plurality of power delivery paths configured to deliver power from the second set of power pins to the first set of power pins for power delivery to the hardware processor; and an alignment frame that aligns the hardware processor, the plurality of power pins, and the mother board.

In Example 33, the subject matter of Example 32 optionally includes wherein power is delivered via the plurality of power delivery paths from the second set of power pins to the first set of power pins for power delivery to the processor.

In Example 34, the subject matter of any one or more of Examples 32-33 optionally include wherein the at least one VR comprises a first VR coupled to a power supply unit, and a second VR coupled to the first VR to supply power to the hardware processor.

In Example 35, the subject matter of Example 34 optionally includes wherein the second VR is coupled to the first VR via an additional VR.

In Example 36, the subject matter of Example 35 optionally includes wherein the second VR is coupled to the first VR via a plurality of additional VRs.

In Example 37, the subject matter of Example 36 optionally includes wherein the plurality of additional VRs are connected in series.

Example 38 is a power delivery system comprising: a hardware processor; a mother board; a voltage regulator (VR) that provides a voltage; and an elastomer computer socket that connects the mother board to the hardware processor, the elastomer computer socket comprising a first set of power pins connected directly to the hardware processor and a second set of power pins connected to the VR, wherein the second set of power pins supplies power to the first set of power pins via a plurality of electrical power delivery paths within the socket.

In Example 39, the subject matter of Example 38 optionally includes an alignment frame that aligns the hardware processor, the plurality of power pins, and the mother board.

Example 40 is a power delivery system comprising: a hardware processor; a mother board; a voltage regulator (VR) that provides an output voltage; and an elastomer computer socket that connects the mother board to the hardware processor, the elastomer computer socket comprising a first set of power pins connected directly to the hardware processor and a second set of power pins connected to the VR, wherein the second set of power pins supplies power to the first set of power pins via a plurality of electrical power delivery paths within the socket, and the VR receives an input voltage from a power supply unit that is located off the socket.

In Example 41, the subject matter of Example 40 optionally includes an alignment frame that aligns the hardware processor, the power pins, and the mother board.

In Example 42, the subject matter can include, or can optionally be combined with any portion or combination of, any portions of any one or more of Examples 1 through 41 to include, subject matter that can include means for performing any one or more of the functions of Examples 1 through 41, or a machine-readable medium including instructions that, when performed by a machine, cause the machine to perform any one or more of the functions of Examples 1 through 41.

Examples, as described herein, may include, or may operate on, logic or a number of components, modules, or mechanisms. Modules are tangible entities (e.g., hardware) capable of performing specified operations and may be configured or arranged in a certain manner. In an example, circuits may be arranged (e.g., internally or with respect to external entities such as other circuits) in a specified manner as a module. In an example, the whole or part of one or more computer systems (e.g., a standalone, client or server computer system) or one or more hardware processors may be configured by firmware or software (e.g., instructions, an application portion, or an application) as a module that operates to perform specified operations. In an example, the software may reside on a machine readable medium. In an example, the software, when executed by the underlying hardware of the module, causes the hardware to perform the specified operations.

Accordingly, the term "module" is understood to encompass a tangible entity, be that an entity that is physically constructed, specifically configured (e.g., hardwired), or temporarily (e.g., transitorily) configured (e.g., programmed) to operate in a specified manner or to perform part or all of any operation described herein. Considering examples in which modules are temporarily configured, each of the modules need not be instantiated at any one moment in time. For example, where the modules comprise a general-purpose hardware processor configured using software, the general-purpose hardware processor may be configured as respective different modules at different times. Software may accordingly configure a hardware processor, for example, to constitute a particular module at one instance of time and to constitute a different module at a different instance of time.

What is claimed is:

1. A power delivery system comprising:

a hardware processor;

a mother board;

a voltage regulator (VR) that provides a voltage for the hardware processor;

an elastomer computer socket that connects the mother board to the hardware processor, the elastomer computer socket comprising a plurality of power pins, each of the plurality of power pins comprising an elastomer column, wherein a first set of power pins is connected to the hardware processor by surface mount elements, and a second set of power pins is not connected to the hardware processor by surface mount elements, and wherein the second set of power pins is directly connected to the VR for power;

a plurality of electrical power delivery paths within the socket, each of the plurality of power delivery paths configured to deliver power from the second set of power pins to the first set of power pins for power delivery to the hardware processor; and an alignment frame that aligns the hardware processor, the plurality of power pins, and the mother board, and the alignment frame comprises walls that are configured to hold the socket to align the surface mount elements and the elastomer columns to the mother board.

2. The power delivery system of claim 1 wherein the plurality of electrical power delivery paths is configured to connect the first set of power pins and the second set of power pins and power is delivered solely from the VR to the hardware processor via the plurality of electrical power delivery paths within the socket.

3. The power delivery system of claim 2 wherein power is delivered from the second set of power pins to the first set of power pins.

4. The power delivery system of claim 2 wherein the plurality of electrical power delivery paths within the socket is part of a flexible printed circuit board (PCB) that is merged into the socket.

5. The power delivery system of claim 2 wherein the VR is on or in the socket.

6. The power delivery system of claim 2 wherein the VR is on or in the mother board.

7. The power delivery system of claim 6 wherein the second set of power pins is connected directly to the mother board.

8. The power delivery system of claim 6 wherein the second set of power pins is connected directly to the mother board by one of pad-on-board connections or through-hole connections.

9. The power delivery system of claim 6 wherein the VR is connected to the second set of power pins by a flexible PCB or a cable.

10. The power delivery system of claim 5 wherein the second set of power pins is connected to a power supply unit, power is provided to the VR via the second set of power pins, and the VR provides power to the hardware processor via the first set of power pins.

11. The power delivery system of claim 10 wherein the VR provides power to the first set of power pins by way of the plurality of power paths in the socket.

12. The power delivery system of claim 2 wherein wherein each elastomer column has a top side and a bottom side, and the top side is connected to a pad that connects the surface mount elements to the top side of the elastomer column.

13. A power delivery system comprising:

a hardware processor;

a mother board;

a voltage regulator (VR) that provides a voltage for the hardware processor;

an elastomer computer socket that connects the mother board to the hardware processor, the elastomer computer socket comprising:

a plurality of power pins wherein a first set of power pins is connected to the hardware processor by surface mount elements, and a second set of power pins is not connected to the hardware processor by surface mount elements, and wherein the second set of power pins is directly connected to the VR for power; and a plurality of elastomer columns, each of the plurality of elastomer columns having a top side and a bottom side, wherein:

the top side is connected to a pad that connects the surface mount elements to the top side of the elastomer column, and the bottom; and the bottom side is connected to a power plane within the motherboard, and the power plane is configured to deliver power directly to the first set of power pins for delivery to the hardware processor;

a plurality of electrical power delivery paths within the socket, each of the plurality of power delivery paths configured to deliver power from the second set of power pins to the first set of power pins for power delivery to the hardware processor; and an alignment frame that aligns the hardware processor, the plurality of power pins, and the mother board.

14. The power delivery system of claim 13 wherein each the alignment frame comprises walls that are configured to hold the socket to align the surface mount elements and the elastomer columns to the mother board.

15. The power delivery system of claim 13 wherein the plurality of electrical power delivery paths is configured to connect the second set of power pins and the first set of power pins and power is delivered to the hardware processor from the VR via the plurality of electrical power delivery paths within the socket, and power is also delivered to the hardware processor via the power plane within the mother board.

16. The power delivery system of claim 15 wherein power is delivered from the second set of power pins to the first set of power pins.

17. The power delivery system of claim 15 wherein the plurality of electrical power delivery paths within the socket is part of a flexible PCB that is merged into the socket.

18. The power delivery system of claim 15, wherein the VR is on or in the socket and the second set of power pins is connected to a power supply unit, power is provided to the VR via the second set of power pins, and the VR provides power to the hardware processor via the first set of power pins.

19. The power delivery system of claim 18 wherein the VR provides power to the first set of power pins by way of the plurality of power paths in the socket.

20. A computer processor comprising:

one or more processor cores;

memory;

a memory controller; and a power delivery system, wherein the power delivery system comprises:

a mother board;

a voltage regulator (VR) that provides a voltage for the computer processor;

an elastomer computer socket that connects the mother board to the computer processor, the elastomer computer socket comprising a plurality of power pins, each of the plurality of power pins comprising an elastomer column, wherein a first set of power pins is connected to the computer processor by surface mount elements, and a second set of power pins is not connected to the computer processor by surface mount elements, and wherein the second set of power pins is directly connected to the VR for power;

a plurality of electrical power delivery paths within the socket, each of the plurality of power delivery paths configured to deliver power from the second set of power pins to the first set of power pins for power delivery to the computer processor; and an alignment frame that aligns the computer processor, the plurality of power pins, and the mother board, and the alignment frame comprises walls that are configured to hold the socket to align the surface mount elements and the elastomer columns to the mother board.

21. The computer processor of claim 20 wherein the plurality of electrical power delivery paths is configured to connect the first set of power pins and the second set of power pins.

22. The computer processor of claim 20 wherein the power delivery system further comprises a power plane within the mother board, the power plane configured to deliver power directly to the first set of power pins for delivery to the computer processor.

23. The computer processor of claim 22 wherein power is delivered to the computer processor from the VR via the plurality of electrical power delivery paths within the socket, the power is also delivered via the power plane within the mother board to the computer processor, and power is delivered from the second set of power pins to the first set of power pins.

* * * * *